United States Patent [19]

McCollum et al.

[11] 3,960,706

[45] June 1, 1976

[54] PROCESS FOR UPGRADING A HYDROCARBON FRACTION

[75] Inventors: John D. McCollum, Munster, Ind.; Leonard M. Quick, Park Forest South, Ill.

[73] Assignee: Standard Oil Company, Chicago, Ill.

[22] Filed: May 31, 1974

[21] Appl. No.: 474,927

[52] U.S. Cl. ..... 208/112; 208/108; 208/110; 208/111; 208/121; 208/217; 208/251 H; 208/254 H

[51] Int. Cl.[2] ..... C10G 13/06; C10G 17/00; C10G 23/00

[58] Field of Search ..... 208/112, 251, 216–217, 208/121, 254, 208 R, 113

[56] References Cited

UNITED STATES PATENTS

| | | | |
|---|---|---|---|
| 2,211,944 | 8/1940 | Andrews et al. | 208/121 |
| 3,453,206 | 7/1969 | Gatsis | 208/210 |
| 3,501,396 | 3/1970 | Gatsis | 208/216 |
| 3,586,621 | 6/1971 | Pitchford et al. | 208/112 |
| 3,676,331 | 7/1972 | Pitchford | 208/112 |
| 3,687,838 | 8/1972 | Seitzer | 208/10 |

*Primary Examiner*—Delbert E. Gantz
*Assistant Examiner*—G. E. Schmitkons
*Attorney, Agent, or Firm*—James R. Henes; Arthur G. Gilkes; William T. McClain

[57] ABSTRACT

A process for upgrading a hydrocarbon fraction and for generating hydrogen in situ by contacting the hydrocarbon fraction with a dense-water-containing fluid at a temperature in the range of from about 600° to about 900°F. in the absence of externally supplied hydrogen and of pretreatment of the hydrocarbon fraction and in the presence of a catalyst system containing a sulfur- and nitrogen-resistant catalyst.

22 Claims, 3 Drawing Figures

PROCESS FOR UPGRADING A HYDROCARBON FRACTION

RELATED APPLICATIONS

This application is related to the following applications which were filed simultaneously with this application and by the same applicants: 474,907; 474,908; 474,909; 474,913; and 474,928.

BACKGROUND OF THE INVENTION

1. Field of the Invention

This invention involves a process for cracking, hydrogenating, desulfurizing, demetalating, and denitrifying a hydrocarbon fraction and for simultaneously generating hydrogen in situ.

2. Description of the Prior Art

As a result of the increasing demand for light hydrocarbon fractions, there is much current interest in more efficient methods for converting the heavier hydrocarbon fractions and products of refining into lighter materials. The conventional methods of accomplishing this, such as catalytic cracking, coking, thermal cracking and the like, always result in the production of more highly refractory materials.

It is known that such heavier hydrocarbon fractions and products and such refractory materials can be converted to lighter materials by hydrocracking. Hydrocracking processes are most commonly employed on liquefied coals or heavy residual or distillate oils for the production of substantial yields of low boiling saturated products and to some extent of intermediates which are utilizable as domestic fuels, and still heavier cuts which find uses as lubricants. These destructive hydrogenation processes or hydrocracking processes may be operated on a strictly thermal basis or in the presence of a catalyst.

However, the application of the hydrocracking technique has in the past been fairly limited because of several interrelated problems. Conversion of heavy petroleum products and hydrocarbon fractions to more useful products by the hydrocracking technique is complicated by the presence of certain contaminants in heavier hydrocarbon fractions and refinery products. Petroleum crude oils and the heavier hydrocarbon fractions and/or distillates obtained therefrom, particularly heavy vacuum gas oils, oil extracted from tar sands, and topped or reduced crudes, contain nitrogenous, sulfurous, and organo-metallic compounds in exceedingly large quantities. The presence of sulfur- and nitrogen-containing and organo-metallic compounds in crude oils and various refined petroleum products and hydrocarbon fractions has long been considered undesirable.

For example, because of the disagreeable odor, corrosive characteristics and combustion products (particularly sulfur dioxide) of sulfur-containing compounds, sulfur removal has been of constant concern to the petroleum refiner. Further, the heavier hydrocarbons are largely subjected to hydrocarbon conversion processes in which the conversion catalysts are, as a rule, highly susceptible to poisoning by sulfur compounds. This has led in the past to the selection of low-sulfur crudes whenever possible. With the necessity of utilizing heavy, high sulfur crude oils in the future, economical desulfurization processes are essential. This need is further emphasized by recent and proposed legislation which seeks to limit sulfur contents of industrial, domestic, and motor fuels.

Generally, sulfur appears in feedstocks in one of the following forms: mercaptans, hydrogen sulfides, sulfides, disulfides, and as part of complex ring compounds. The mercaptans and hydrogen sulfides are more reactive and are generally found in the lower boiling fractions, for example, gasoline, naphtha, kerosene, and light gas oil fractions. There are several well-known processes for sulfur removal from such lower boiling fractions. However, sulfur removal from higher boiling fractions has been a more difficult problem. Here, sulfur is present for the most part in less reactive forms like sulfides, disulfides, and as part of complex ring compounds of which thiophene is a prototype. Such sulfur compounds are not susceptible to the conventional chemical treatments found satisfactory for the removal of mercaptans and hydrogen sulfides and are particularly difficult to remove from heavy hydrocarbon materials.

Nitrogen is undesirable because it effectively poisons various catalytic composites which may be employed in the conversion of heavy hydrocarbon fractions. In particular, nitrogen-containing compounds are effective in suppressing hydrocracking. Moreover, nitrogenous compounds are objectionable because combustion of fuels containing these impurities possibly contributes to the release of nitrogen oxides which are noxious and corrosive and present a serious problem with respect to pollution of the atmosphere. Consequently, removal of the nitrogenous contaminants is most important and makes practical and economically attractive the treatment of contaminated stocks.

However, in order to remove the sulfur or nitrogen or to convert the heavy residue into lighter more valuable products, the crude oil or heavy hydrocarbon fraction is ordinarily subjected to a hydrocatalytic treatment. This is conventionally done by contacting the oil or hydrocarbon fraction with hydrogen at an elevated temperature and pressure and in the presence of a catalyst. Unfortunately, unlike distillate stocks which are substantially free from asphaltenes and metals, the presence of asphaltenes and metal-containing compounds in the heavy hydrocarbon fractions leads to a relatively rapid reduction in the activity of the catalyst to below a practical level. The presence of these materials in the charge stock results in the deposition of metal-containing coke on the catalyst particles, which prevents the charge from coming in contact with the catalyst and thereby, in effect, reduces the catalytic activity. Eventually, the on-stream period must be interrupted, and the catalyst must be regenerated or replaced with fresh catalyst.

Particularly objectionable is the presence of iron in the form of soluble organometallic compounds, such as is present frequently to a relatively high parts-per-million level in Western United States crude oils and residuum fractions. Even when the concentration of iron porphyrin complexes and other iron organometallic complexes is relatively small, that is, on the order of parts per million, their presence causes serious difficulties in the refining and utilization of heavy hydrocarbon fractions. The presence of an appreciable quantity of the organometallic iron compounds in feedstocks undergoing catalytic cracking causes rapid deterioration of the cracking catalysts and changes the selectivity of the cracking catalysts in the direction of more of the charge stock being converted to coke. Also, the presence of an appreciable quantity of the organo-iron compounds in feedstocks undergoing hydroconversion (such as hydrotreating or hydrocracking) causes harmful effects in the hydroconversion processes, such as deactivation of the hydroconversion catalyst and, in many instances, plugging or increasing of the pressure drop in fixed bed hydroconversion reactors due to the deposition of iron compounds in the interstices between catalyst particles in the fixed bed of catalyst.

Additionally, metallic contaminants such as nickel- and vanadium-containing compounds are found as innate contaminants in practically all crude oils associated with the high Conradson carbon asphaltic and/or asphaltenic portion of the crude. When the crude oil is topped to remove the light fractions boiling above about 450°–650°F., the metals are concentrated in the residual bottoms. If the residuum is then further treated, such metals adversely affect catalysts. When the oil is used as a fuel, the metals also cause poor fuel oil performance in industrial furnaces by corroding the metal surfaces of the furnace.

There have been numerous references to processes for hydrogenating, cracking, desulfurizing, denitrifying, demetalating, and generally upgrading hydrocarbon fractions by processes involving water. For example, Gatsis, U.S. Pat. No. 3,453,206 (1969) discloses a multistage process for hydrorefining heavy hydrocarbon fractions for the purpose of eliminating and/or reducing the concentration of sulfurous, nitrogenous, organo-metallic, and asphaltenic contaminants therefrom. The nitrogenous and sulfurous contaminants are converted to ammonia and hydrogen sulfide. The stages comprise pretreating the hydrocarbon fraction, in the absence of a catalyst, with a mixture of water and externally supplied hydrogen at a temperature above the critical temperature of water and a pressure of at least 1,000 pounds per square inch gauge and then reacting the liquid product from the pretreatment stage with externally supplied hydrogen at hydrorefining conditions and in the presence of a catalytic composite. The catalytic composite comprises a metallic component composited with a refractory inorganic oxide carrier material of either synthetic or natural origin, which carrier material has a medium-to-high surface area and a well-developed pore structure. The metallic component can be vanadium, niobium, tantalum, molybdenum, tungsten, chromium, iron, cobalt, nickel, platinum, palladium, iridium, osmium, rhodium, ruthenium, and mixtures thereof.

Gatsis, U.S. Pat. No. 3,501,396 (1970) discloses a process for desulfurizing and denitrifying oil which comprises mixing the oil with water at a temperature above the critical temperature of water up to about 800°F. and at a pressure in the range of from about 100 to about 2500 pounds per square inch gauge and reacting the resulting mixture with externally supplied hydrogen in contact with a catalytic composite. The catalytic composite can be characterized as a dual function catalyst comprising a metallic component such as iridium, osmium, rhodium, ruthenium and mixtures thereof and an acidic carrier component having cracking activity. An essential feature of this method is the catalyst being acidic in nature. Ammonia and hydrogen sulfide are produced in the conversion of nitrogenous and sulfurous compounds, respectively.

Pritchford et al., U.S. Pat. No. 3,586,621 (1971) discloses a method for converting heavy hydrocarbon oils, residual hydrocarbon fractions, and solid carbonaceous materials to more useful gaseous and liquid products by contacting the material to be converted with a nickel spinel catalyst promoted with a barium salt of an organic acid in the presence of steam. A temperature in the range of from 600°F. to about 1,000°F. and a pressure in the range of from 200 to 3,000 pounds per square inch gauge are employed.

Pritchford, U.S. Pat. No. 3,676,331 (1972) discloses a method for upgrading hydrocarbons and thereby producing materials of low molecular weight and of reduced sulfur content and carbon residue by introducing water and a catalyst system containing at least two components into the hydrocarbon fraction. The water can be the natural water content of the hydrocarbon fraction or can be added to the hydrocarbon fraction from an external source. The water-to-hydrocarbon fraction volume ratio is preferably in the range from about 0.1 to about 5. At least the first of the components of the catalyst system promotes the generation of hydrogen by reaction of water in the water gas shift reaction and at least the second of the components of the catalyst system promotes reaction between the hydrogen generated and the constituents of the hydrocarbon fraction. Suitable materials for use as the first component of the catalyst system are the carboxylic acid salts of barium, calcium, strontium, and magnesium. Suitable materials for use as the second component of the catalyst system are the carboxylic acid salts of nickel, cobalt, and iron. The process is carried out at a reaction temperature in the range of from about 750° to about 850°F. and at a pressure of from about 300 to about 4,000 pounds per square inch gauge in order to maintain a principal portion of the crude oil in the liquid state.

Wilson et al., U.S. Pat. No. 3,733,259 (1973) discloses a process for removing metals, asphaltenes, and sulfur from a heavy hydrocarbon oil. The process comprises dispersing the oil with water, maintaining this dispersion at a temperature between 750° and 850°F. and at a pressure between atmospheric and 100 pounds per square inch gauge, cooling the dispersion after at least one-half hour to form a stable water-asphaltene emulsion, separating the emulsion from the treated oil, adding hydrogen, and contacting the resulting treated oil with a hydrogenation catalyst at a temperature between 500° and 900°F. and at a pressure between about 300 and 3,000 pounds per square inch gauge.

It has also been announced that the semi-governmental Japan Atomic Energy Research Institute, working with the Chisso Engineering Corporation, has developed what is called a "simple, low-cost, hot-water, oil desulfurization process" said to have "sufficient commercial applicability to compete with the hydrogenation process." The process itself consists of passing oil through a pressurized boiling water tank in which water is heated up to approximately 250°C., under a pressure of about 100 atmospheres. Sulfides in oil are then separated when the water temperature is reduced to less than 100°C.

Thus far, no one has disclosed the method of this invention for upgrading hydrocarbon fractions, which permits operation, at lower than conventional temperatures, without evidence of sulfur- or nitrogen-poisoning of the catalyst, without an external source of hydrogen, and without preparation or pretreatment of the hydrocarbon fraction, such as, desalting or demetalation.

SUMMARY OF THE INVENTION

This invention is a process for cracking, hydrogenating, desulfurizing, demetalating, and denitrifying a hydrocarbon fraction containing paraffins, olefins, olefin-equivalents, or acetylenes, as such or as substituents on ring compounds, which comprises contacting the hydrocarbon fraction with a water-containing fluid at a temperature in the range of from about 600° to about 900°F., in the absence of externally supplied hydrogen and of pretreatment of the hydrocarbon fraction and in the presence of an externally supplied catalyst system containing a sulfur- and nitrogen-resistant catalyst selected from the group consisting of at least one soluble or insoluble transition metal compound and a transition metal deposited on a support. The density of water in the water-containing fluid is at least 0.10 gram per milliliter, and sufficient water is present to serve as an effective solvent for the hydrocarbon fraction. Essentially all the sulfur removed from the hydrocarbon fraction is in the form of elemental sulfur. In this process, hydrogen is generated in situ.

The density of water in the water-containing fluid is preferably at least 0.15 gram per milliliter and most preferably at least 0.2 gram per milliliter. The temperature is preferably at least 705°F., the critical temperature of water. The hydrocarbon fraction and water-containing fluid are contacted preferably for a period of time in the range of from about 1 minute to about 6 hours, more preferably in the range of from about 5 minutes to about 3 hours and most preferably in the range of from about 10 minutes to about 1 hour. The weight ratio of the hydrocarbon fraction-to-water in the water containing fluid is preferably in the range of from about 1:1 to about 1:10 and more preferably in the range of from about 1:2 to about 1:3. The water-containing fluid is preferably substantially water and more preferably water.

The catalyst preferably is selected from the group consisting of ruthenium, rhodium, iridium, osmium, paladium, nickel, cobalt, platinum, and combinations thereof and most preferably is selected from the group consisting of ruthenium, rhodium, iridium, osmium, and combinations thereof. The catalyst is present in a catalytically effective amount which is equivalent to a concentration level in the water in the water-containing fluid in the range of from about 0.02 to about 1.0 weight percent and preferably in the range of from about 0.05 to about 0.15 weight percent.

Preferably the catalyst system contains additionally a promoter selected from the group consisting of at least one basic metal hydroxide, basic metal carbonate, transition metal oxide, oxide-forming transition metal salt and combinations thereof. The promoter promotes the activity of the catalyst and directs selectivity between generating hydrogen in situ and cracking the hydrocarbon fraction. The transition metal in the oxide and salt is preferably selected from the group consisting of a transition metal of Group IVB, VB, VIB, and VIIB of the Periodic Chart and is more preferably selected from the group consisting of vanadium, chromium, manganese, iron, titanium, molybdenum, copper, zirconium, niobium, tantalum, rhenium, and tungsten and is most preferably selected from the group consisting of chromium, manganese, titanium, tantalum, and tungsten. The metal in the basic metal carbonate and hydroxide is preferably selected from the group consisting of alkali and alkaline earth metals and more preferably is selected from the group consisting of sodium and potassium. The ratio of the number of atoms of metal in the promoter to the number of atoms of metal in the catalyst is preferably in the range of from about 0.5 to about 50 and most preferably in the range of from about 3 to about 5.

DETAILED DESCRIPTION

Figure 1:
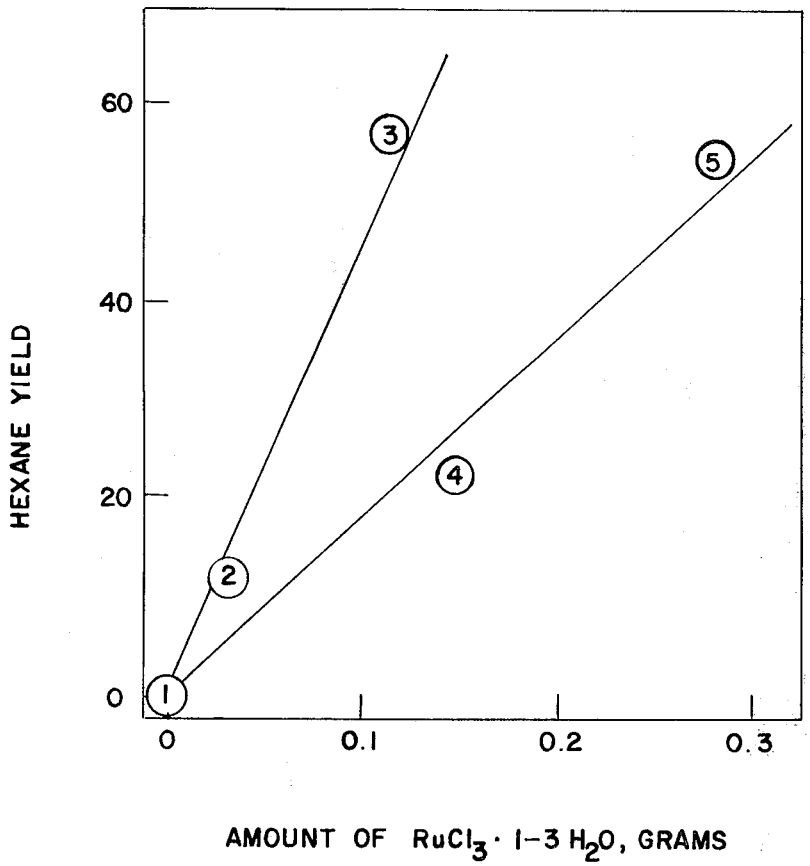
FIG. 1 is a series of plots showing the effect on the formation of hexane from 1-hexane of varying amounts of a catalyst in the presence of a fixed amount of a promoter.

It has been found that hydrocarbons containing paraffins, olefins, olefin-equivalents — for example, alcohols and aldehydes — or acetylenes, as such or as substituents on ring compounds, can be upgraded, cracked, hydrogenated, desulfurized,demetalated, and denitrified and that hydrogen can be generated in situ by contacting such hydrocarbons with a dense-water-containing phase, either gas or liquid, at a reaction temperature in the range of from about 600° to about 900°F. in the absence of an external source of hydrogen and in the presence of a transition metal catalyst. This method is applicable to the whole range of hydrocarbon fractions, including both light materials and heavy materials such as gas oil, residual oils, tar sands oil, oil shale kerogen extracts, and liquefied coal products. desulfurized, demetalated, The generation of hydrogen in situ is effected through the "water-reforming" process. In the water-reforming process, part of the hydrocarbon fraction reacts, under the conditions described above, with water to form carbon monoxide and hydrogen in situ. The carbon dioxide reacts with water by the water-gas shift to form carbon dioxide and more hydrogen in situ. The hydrogen thus produced is then consumed in hydrogenation, hydrocracking, denitrification, and possibly desulfurization and demetalation.

We have found that, in order to effect chemical conversions of heavy hydrocarbon fractions into lighter, more useful hydrocarbon fractions by the method of this invention — which involves processes characteristically occurring in solution rather than typical pyrolytic processes — the water in the dense-water-containing fluid phase must have a high solvent power and liquid-like densities — for example, at least 0.1 gram per milliliter — rather than vapor-like densities. Maintenance of the water in the dense-water-containing phase at a relatively high density, whether at temperatures below or above the critical temperature of water, is essential to the method of this invention. The density of the water in the dense-water-containing phase must be at least 0.1 gram per milliliter.

The high solvent power of dense fluids is discussed in the monogram "The Principles of Gas Extraction" by P. F. M. Paul and W. S. Wise, published by Mills and Boon Limited in London, 1971, of which Chapters 1 through 4 are specifically incorporated herein by reference. For example, the difference in the solvent power of steam and of dense gaseous water maintained at a temperature in the region of the critical temperature of water and at an elevated pressure is substantial. Even normally insoluble inorganic materials, such as silica and alumina, commence to dissolve appreciably in "supercritical water" —that is, water maintained at a temperature above the critical temperature of water — so long as a high water density is maintained.

Enough water must be employed so that there is sufficient water in the dense-water-containing phase to serve as an effective solvent for the hydrocarbons. The water in the dense-water-containing phase can be in the form either of liquid water or of dense gaseous water. The vapor pressure of water in the dense-water-containing phase must be maintained at a sufficiently high level so that the density of water in the dense-water-containing phase is at least 0.1 gram per milliliter. We have found that, with the limitations imposed by the size of the reaction vessels we employed in this work, a weight ratio of the hydrocarbon fraction-to-water in the dense-water-containing phase in the range of from about 1:1 to about 1:10 is preferable, and a ratio in the range of from about 1:2 to about 1:3 is more preferable.

A particularly useful water-containing fluid contains water in combination with an organic compound such as biphenyl, pyridine, a partly hydrogenated aromatic oil, or a mono- or polyhydric compound such as methyl alcohol. The use of such combinations extends the limits of solubility and rates of dissolution so that cracking, hydrogenation, desulfurization, demetalation, and denitrification can occur even more readily. Furthermore, the component other than water in the dense-water-containing phase can serve as a source of hydrogen, for example, by reaction with water.

The catalyst employed in the method of this invention is effective when added in an amount equivalent to a concentration in the water of the water-containing fluid in the range of from about 0.02 to about 1.0 weight percent and preferably in the range of from about 0.05 to about 0.15 weight percent.

If the catalyst is not soluble in the water-containing fluid, then it may be deposited on a support. Charcoal, active carbon, alundum, and oxides such as silica, alumina, manganese dioxide, and titanium dioxide have been used successfully as supports for insoluble catalysts. However, high surface-area silica and alumina have only been satisfactory supports at reaction temperatures lower than the critical temperature of water.

Any suitable conventional method for depositing a catalyst on a support known to those in the art can be used. One suitable method involves immersing the support in a solution containing the desired weight of catalyst dissolved in a suitable solvent. The solvent is then removed, and the support with the catalyst deposited thereon is dried. The support and catalyst are then calcined in an inert gas stream at about 550°C. for from 4 to 6 hours. The catalyst can then be reduced or oxidized as desired.

The method can be performed either as a batch process or as a continuous or semi-continuous flow process. Contact times between the hydrocarbon fraction and the dense-water-containing phase — that is, residence time in a batch process or inverse solvent space velocity in a flow process — of from the order of minutes up to about 6 hours are satisfactory for effective cracking, hydrogenation, desulfurization, demetalation, and denitrification of the hydrocarbon fraction.

EXAMPLES 1–154

Examples 1–154 involve batch processing of different types of hydrocarbon feedstocks under a variety of conditions. Unless otherwise specified, the following procedure was used in each case. The hydrocarbon feed, water-containing fluid, and the components of the catalyst system, if present, were loaded at ambient temperature into a Hastelloy alloy C Magne-Drive or Hastelloy alloy B Magne-Dash autoclave in which the reaction mixture was to be mixed. The components of the catalyst system were added as solutes in the water-containing fluid or as solids in slurries in the water-containing fluid. Unless otherwise specified, sufficient water was added in each Example so that, at the reaction temperature and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660°F. Approximately 6 more minutes were required to raise the temperature from 660° to 700°F. Approximately, another 6 minutes were required to raise the temperature from 700° to 750°F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized and was flash-distilled from the reaction vessel, removing the gas, water-containing fluid, and "light" ends, and leaving the "heavy" ends, catalyst, if present, and other solids in the reaction vessel. The light ends were the hydrocarbon fraction boiling at or below the reaction temperature, and the heavy ends were the hydrocarbon fraction boiling above the reaction temperature.

The gas, water-containing fluid, and light ends were trapped in a pressure vessel cooled by liquid nitrogen. The gas was removed by warming the pressure vessel to room temperature and then was analyzed by mass spectroscopy, gas chromatography, and infra-red. The water-containing phase and light ends were then purged from the pressure vessel by means of compressed gas and occasionally by heating the vessel. Then the water-containing fluid and light ends were separated by decantation. Alternately, this separation was postponed until a later stage in the procedure. Gas chromatograms were run on the light ends.

The heavy ends and solids, including the catalyst, if present, were washed from the reaction vessel with chloroform, and the heavy ends dissolved in this solvent. The solids, including the catalyst, if present, were then separated from the solution containing the heavy ends by filtration.

After separating the chloroform from the heavy ends by distillation, the light ends and heavy ends were combined. If the water-containing fluid had not already been separated from the light ends, then it was separated from the combined light and heavy ends by centrifugation and decantation. The combined light and heavy ends were analyzed for their nickel, vanadium, and sulfur content, carbon-hydrogen atom ratio (C/H), and API gravity. The water was analyzed for nickel and vanadium, and the solids were analyzed for nickel, vanadium, and sulfur. X-ray fluoresense was used to determine nickel, vanadium, and sulfur.

Examples 1–3 illustrate that the catalysts employed in the method of this invention are not subject to poisoning by sulfur-containing compounds. Three runs were made, each with carbon monoxide in the amount of 350 pounds per square inch gauge in 90 milliliters of water, in a 240-milliliter Magne-Dash autoclave for a reaction time of four hours. Soluble ruthenium trichloride in the amount of 0.1 gram of $RuCl_3.1–3H_2O$ was employed as the catalyst in these Examples. Additionally, in Example 2, the water contained 1 milliliter of thiophene. The reaction conditions and the compositions of the products in each run are shown in Table 1. The presence of a sulfur-containing compound, thiophene, did not cause poisoning of the catalyst or inhibition of the water-gas shift.

TABLE 1

| Example | Reaction Temperature (°F.) | Reaction Pressure[1] | Product Composition[2] | | |
|---|---|---|---|---|---|
| | | | $H_2$ | $CO_2$ | CO |
| 1 | 670 | 2500 | 39 | 32 | 29 |
| 2 | 662 | 2500 | 25 | 23 | 52 |
| 3 | 662 | 2550 | 26 | 22 | 52 |

Footnotes
[1]pounds per square inch gauge.
[2]normalized mole percent of gas.

Example 4 illustrates that the catalyst system operates as a catalyst for the hydrogenation of unsaturated organic compounds. When 15 grams of 1-octene was contacted with 30 grams of water in a 100-milliliter Magne-Dash autoclave for 7 hours at a temperature of 662°F. at a reaction pressure of 3500 pounds per square inch gauge and an argon pressure of 800 pounds per square inch gauge, in the presence of soluble $RuCl_3.1–3H_2O$ catalyst, carbon dioxide, hydrogen, methane, octane, cis- and trans-2-octene, and paraffins and olefins containing five, six, and seven carbon atoms were found in an analysis of the products. These products indicate that substantial cracking and isomerization of the skeleton and of the location of the site of unsaturation occur. A 40% yield of octane was obtained when 15 grams of 1-octene and 30 grams of water were reacted in the presence of 0.1 gram of $RuCl_3.1-3H_2O$ for 3 hours, in the same reactor and at the same temperature, at a reaction pressure of 2,480 pounds per square inch gauge and an argon pressure of 200 pounds per square inch gauge. A 75% yield of octane was obtained from the same reaction mixture, in the same reactor, and under the same conditions, but after a reaction time of 7 hours and at a reaction pressure of 3,470 pounds per square inch gauge and an argon pressure of 800 pounds per square inch gauge.

Examples 5–6 involve runs wherein sulfur-containing compounds, for example, thiophene and benzothiophene, are decomposed to hydrocarbons, carbon dioxide, and elemental sulfur. These Examples illustrate the efficiency of the catalyst system in catalyzing the desulfurization of sulfur-containing organic compounds.

In Example 5, a reaction mixture of 12 milliliters of thiophene and 90 milliliters of water reacted in a 240-milliliter Magne-Dash autoclave in the presence of 0.1 gram of soluble $RuCl_3.1-3-H_2O$ catalyst at a reaction temperature of 662°F., under a reaction pressure of 3150 pounds per square inch gauge and an argon pressure of 650 pounds per square inch gauge, and for a reaction time of 4 hours to yield $C_1$ to $C_4$ hydrocarbons and 0.1 gram of solid elemental sulfur but no detectable amounts of sulfur oxides or hydrogen disulfide.

In Example 6, a mixture of 23 milliliters of a solution of 8 mole percent thiophene (that is, about 3 weight percent sulfur) in 1-hexene and 90 milliliters of water reacted in a 240-milliliter Magne-Dash autoclave in the presence of 2 grams of solid alumina support containing 5 weight percent of ruthenium (equivalent to 0.1 gram of $RuCl_3.1-3H_2O$) at a reaction temperature of 662°F., under a reaction pressure of 3,500 pounds per square inch gauge and an argon pressure of 600 pounds per square inch gauge, and for a reaction time of 4 hours to yield hydrocarbon products containing sulfur in the amount of 0.9 weight percent of the hydrocarbon feed and in the form of thiophene. This decrease in the thiophene concentration corresponds to a 70% desulfurization. The activity of the catalyst was undiminished through 4 successive batch runs.

Examples 7–14 involve the processing of samples of vacuum gas oil and residual fuels and illustrate that the catalyst system effectively catalyzes the desulfurization, demetalation, cracking and upgrading of hydrocarbon fractions. The compositions of the hydrocarbon feeds used are shown in Table 2. The residual oils used in these Examples are designated by the Letter A in Table 2.

Examples 7–10 involve vacuum gas oil; Examples 11–12 involve C atmospheric residual oil; and Examples 13–14 involve Kafji residual oil. Example 7 involves vacuum gas oil under similar conditions as those used in Examples 8–10 but in the absence of catalyst, and is presented for the purpose of comparison. The experimental conditions, product composition, and extent of sulfur, nickel, and vanadium removal in these Examples are shown in Table 3. The liquid products are characterized as lower boiling or higher boiling depending whether they boil at or below the reaction temperature or above the reaction temperature, respectively. The reaction temperature was 715°F., and a 300-milliliter Hastelloy alloy BMagne-Dash autoclave was used in each Example. Ruthenium, rhodium, and osmium were added in the form of soluble $RuCl_3.1-3H_2O$, $RhCl_3.3H_2O$, and $OsCl_3.3H_2O$, respectivey. The percent of sulfur, nickel, and vanadium removal are reported as the percent of the sulfur, nickel, and vanadium content of the hydrocarbon feed removed from the product.

TABLE 2

| Analysis | Atmospheric Residual Oils-A | | | Tar Sands Oils | | Atmospheric Residual Oils-B | | | C Vacuum Residual Oil |
|---|---|---|---|---|---|---|---|---|---|
| | Vacuum Gas Oil | C | Kafji | Straight | Topped | Khafji | C | Cyrus | |
| Sulfur[1] | 2.56 | 3.6 | 4.3 | 4.56 | 5.17 | 3.89 | 3.44 | 5.45 | 4.64 |
| Vanadium[2] | | 30 | 84 | 182 | 275 | 93 | 25 | 175 | 54 |
| Nickel[2] | | 14 | 30 | 74 | 104 | 31 | 16 | 59 | 34 |
| Carbon[1] | | | | 83.72 | 82.39 | 84.47 | 85.04 | 84.25 | 84.88 |
| Hydrogen[1] | | | | 10.56 | 9.99 | 10.99 | 11.08 | 10.20 | 10.08 |
| H/C atom ratio | | | | 1.514 | 1.455 | 1.56 | 1.56 | 1.45 | 1.43 |
| API gravity[3] | | | | 12.2 | 7.1 | 14.8 | 15.4 | 9.8 | 5.4 |
| Fraction boiling[1] lower than 650°F. | 15 | 15 | 15 | 29.4 | 9.7 | 10.6 | 12.0 | 6.9 | 9.1 |

Footr~tes
[1]weight percent.
[2]parts per million.
[3]°API.

TABLE 3

| | Example 7 | Example 8 | Example 9 | Example 10 | Example 11 | Example 12 | Example 13 | Example 14 |
|---|---|---|---|---|---|---|---|---|
| Reaction pressure[1] | 2700 | 2300 | 3500 | 3700 | 3650 | 3775 | 3630 | 3650 |
| Argon pressure[1] | 450 | 450 | 300 | 450 | 400 | 450 | 400 | 400 |
| Reaction time[2] | 7 | 6 | 6 | 2 | 16 | 16 | 13 | 13 |
| Oil-to-water weight ratio | 5.4 | 6 | 0.2 | 0.3 | 0.3 | 0.3 | 0.3 | 0.3 |
| Water added[3] | 20 | 20 | 96 | 90 | 96 | 96 | 96 | 96 |
| Catalyst | None | Ru | Ru | Os+Rh | Ru | Os | Ru | Os |
| Catalyst concentration[4] | — | 0.03 | 0.04 | 0.07+ 0.03 | 0.03 | 0.09 | 0.03 | 0.09 |
| Product Composition[5] | | | | | | | | |
| Gas | 3 | 4 | 11 | 21 | 12 | 22 | 10 | 10 |
| Lower boiling liquid | 49 | 46 | 79 | 79 | 50 | — | 22 | 30 |
| Higher boiling liquid | 48 | 50 | 10 | 0 | 32 | — | 68 | 51 |
| Sulfur content[6] | 2.36 | 2.25 | 1.97 | 2.08 | 2.0 | 2.6 | 2.8 | 3.4 |
| Nickel content[6,7] | — | — | — | — | 9 | — | 10 | 2 |
| Vanadium content[6,7] | — | — | — | — | 6 | — | 16 | 9 |
| Percent sulfur removal | 8 | 12 | 23 | 20 | 48 | 28 | 34 | 20 |
| Percent nickel removal | — | — | — | — | 36 | — | 67 | 93 |
| Percent vanadium removal | — | — | — | — | 80 | — | 81 | 89 |

Footnotes
[1]pounds per square inch gauge.
[2]hours.
[3]grams.
[4]The amounts of catalyst added are presented in grams in the same order in which the corresponding catalysts are listed.
[5]weight percent of the hydrocarbon feed except where otherwise indicated.
[6]obtained from an analysis of the combined liquid fractions.
[7]parts per million.

Comparison of the results in Table 3 indicates that even thermal processing without the addition of catalyst from an external source causes considerable cracking and upgrading and a small amount of desulfurization of the hydrocarbon fraction. With a relatively high oil-to-water weight ratio, the compositions of the products obtained from thermal processing and from processing in the presence of a ruthenium catalyst are similar. With a lower oil-to-water weight ratio, analysis of the products reveals more extensive cracking in the presence of a ruthenium catalyst. Moreover, under similar conditions and with a ruthenium or a rhodium-osmium combination catalyst, there is essentially complete conversion of liquid feed into gases and liquid products boiling at temperatures equal to or less than the reaction temperature. The sulfur which was removed by desulfurization was in the form of elemental sulfur when the water density was at least 0.1 gram per milliliter — for example, when the oil-to-water weight ratio was 0.2 or 0.3. However, the removed sulfur was in the form of hydrogen sulfide when the water density was less than 0.1 gram per milliliter — for example, when the oil-to-water weight ratio was 5.4 to 6. This clearly indicates a change in the mechanism of desulfurization of organic compounds on contact with a dense-water-containing phase depending on the water density of the dense-water-containing phase.

Examples 15–16 involve promoters for the catalyst system of this invention. Basic metal hydroxides and carbonates and transition metal oxides, preferably oxides of metals in Groups IVB, VB, VIB, and VIIB of the Periodic Chart, do not function as catalysts for the water-reforming process but do effectively promote the activity of the catalysts of this invention which do catalyze water-reforming.

The promoter may be added as a solid and slurried in the reaction mixture or as a water-soluble salt, for example manganese chloride or potassium permanganate, which produces the corresponding oxide under the conditions employed in the method of this invention. Alternately, the promoter can be deposited on a support and used as such in a fixed-bed flow configuration or slurried in the water-containing fluid. The ratio of the number of atoms of metal in the promoter to the number of atoms of metal in the catalyst is in the range of from about 0.5 to about 50 and preferably from about 3 to about 5.

The yields of the products of the water-reforming process are good indicators of promotional activity. In the water-reforming process, hydrogen and carbon monoxide are formed in situ by the reaction of part of the hydrocarbon feed with water. The carbon monoxide produced reacts with water forming carbon dioxide and additional hydrogen in situ. The hydrogen thus generated then reacts with part of the hydrocarbon feed to form saturated materials. Additionally, some hydrocarbon hydrocracks to form methane. Thus, the yields of saturated product, carbon dioxide, and methane are good measures of the promotional activity when a promoter is present in the catalyst system.

Figure 2:
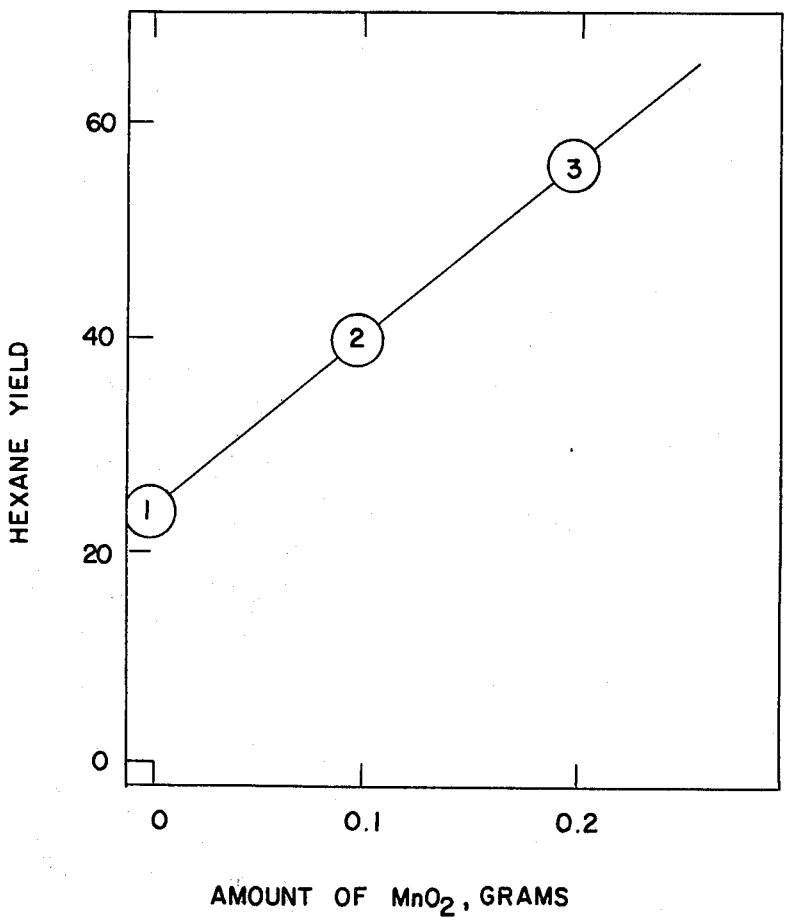
FIG. 2 is a plot showing the effect on the formation of hexane from 1-hexene of varying amounts of a promoter in the presence of a fixed amount of a catalyst.

The yields of hexane obtained by processing 1-hexene in Examples 15 and 16 are presented in FIGS. 1 and 2, respectively. The hexane yield is shown in terms of the mole percent of 1-hexene feed which is converted to hexane in the product.

In Examples 15 and 16, a reaction temperature of 662°F., a reaction time of 2 hours, 90 grams of water, 17 ± 0.5 grams of 1-hexene, and a 300-milliliter Hastelloy alloy B Magne-Dash autoclave were employed. In FIG. 1, the runs from which points labelled 1 through 5 were obtained employed reaction pressures of 3450, 3400, 2800, 3450, and 3500 pounds per square inch gauge, respectively, and argon pressures of 650, 650, 0, 620, and 620 pounds per square inch gauge, respectively. Runs corresponding to points labelled 1 through 3 employed 0.2 gram of manganese dioxide as promoter, while runs corresponding to points labelled 4 and 5 employed no promoter. In FIG. 2, the runs from which points labelled 1 through 3 were obtained employed reaction pressures of 2800, 3560, and 2900 pounds per square inch gauge, respectively, and argon pressures of 650 pounds per square inch gauge.

FIG. 1 shows the increase of hexane yield with increasing amounts of ruthenium catalyst and with either no promoter added or 0.2 gram of manganese dioxide promoter added. Similarly, FIG. 2 shows the increase of hexane yield with increasing amounts of manganese dioxide promoter and 0.1 gram of $RuCl_3.1\text{-}3H_2O$ catalyst present. These plots indicate that, in the absence of catalyst, the promoter alone showed no water-reforming catalytic activity, with the hexane yield being less than 2 mole percent of the feed. Also, for a given concentration of catalyst, addition of 0.2 gram of the promoter produced substantially increased yields of hexane in the product.

Examples 17–30 involved 2-hour batch runs in a 300-milliliter Hastelloy alloy B Magne-Dash autoclave which employed 0.1 gram of $RuCl_3.1\text{-}3H_2O$ catalyst and 0.2 gram of various transition metal oxides at 662°F. The argon pressure was 650 pounds per square inch gauge in each Example. The yields of hexane, carbon dioxide, and methane are shown in Table 4.

There was an increase in the yield of hexane with all of the oxides used except barium oxide. There was only a small increase in the yield of hexane when copper (II) oxide was used. Thus, of the promoters shown, efficient promotion of catalytic activity in water-reforming is achieved primarily with transition metal oxides.

TABLE 4

| | | Feed Composition[1] | | | Yields | | |
|---|---|---|---|---|---|---|---|
| Example | Promoter | 1-Hexene | Water | Reaction Pressure[2] | Hexane[3] | Carbon dioxide[4] | Methane[4] |
| 17 | — | 17.8 | 88.8 | 2900 | 25 | 0.04 | 0.03 |
| 18 | $V_2O_5$ | 16.4 | 90.9 | — | 39 | 0.07 | 0.04 |
| 19 | $Cr_2O_3$ | 16.6 | 89.8 | 3325 | 32 | 0.07 | 0.02 |
| 20 | $MnO_2$ | 16.9 | 90.0 | 3500 | 57 | 0.05 | 0.06 |
| 21 | $Fe_2O_3$ | 15.9 | 88.7 | — | 37 | 0.09 | 0.03 |
| 22 | $TiO_2$ | 16.5 | 89.1 | — | 30 | 0.05 | 0.03 |
| 23 | $MoO_3$ | 16.4 | 89.5 | 3450 | 30 | 0.065 | 0.06 |
| 24 | CuO | 16.2 | 89.8 | — | 17 | 0.025 | — |
| 25 | BaO | 16.3 | 90.0 | 3250 | 2 | 0 | 0 |
| 26 | $ZrO_2$ | 16.4 | 90.1 | 3600 | 27 | 0.08 | 0.011 |
| 27 | $Nb_2O_5$ | 16.5 | 90.5 | 3000 | 26 | 0.068 | 0.010 |
| 28 | $Ta_2O_5$ | 12.5 | 75.8 | 3850 | 27 | 0.038 | 0.007 |
| 29 | $ReO_2$ | 16.4 | 89.2 | — | 27 | 0.01 | — |
| 30 | $WO_3$ | 17.6 | 90.6 | — | 33 | 0.053 | 0.009 |

Footnotes
[1]grams.
[2]pounds per square inch gauge.
[3]mole percent of hydrocarbon feed.
[4]moles.

The ratio of the yield to methane in moles either to the yield of carbon dioxide in moles or to the yield of hexane in mole percent of the hydrocarbon feed is an indication of the relative extents to which the competing reactions of hydrocracking and in situ hydrogen formation by water-reforming proceed. The result shown in Table 4 indicate that a given promoter catalyzes hydrocracking and hydrogen production to different degrees. Consequently, by choosing one promoter over another, it is possible to direct selectively toward either hydrocracking or hydrogen production, as well as to promote the activity of the catalyst.

No theory is proposed for the mechanism by which basic metal hydroxides and carbonates and transition metal oxides promote the activity of the catalysts in the method of this invention. However, there is evidence to indicate that the promotion of catalytic activity by transition metal oxides at least is a chemical effect and not a surface effect. To illustrate, Example 31 was performed under the same experimental conditions as those used in Example 17 but employed instead a catalyst of 1 gram of high surface area, active carbon chips containing 5% by weight of ruthenium — that is, 0.5 millimole of ruthenium, which is equivalent to 0.1 gram of $RuCl_3.1\text{-}3H_2O$ — with no promoter being present. The carbon chips had a surface area of 500 square meters per gram. The yield of hexane was 12 mole percent, and the yield of carbon dioxide was 0.017 mole. Both of these yields were smaller than the corresponding yields found in Example 17 in the absence of a promoter.

Examples 32–38 demonstrate the varying degrees of effectiveness of different combinations of catalysts and promoters in catalyzing cracking, hydrogenation, skeletal isomerization, and olefin-position isomerization of the hydrocarbon feed. In each case, the hydrocarbon feed was a solution of 36 mole percent of 1-hexene in the diluent benzene, except Example 36 where the benzene was replaced by ethylbenzene. In each Example, the reaction was carried out in a 300-milliliter Hastelloy alloy B Magne-Dash autoclave under an argon pressure of 650 pounds per square inch gauge at a reaction temperature of 662°F. and for a reaction time of 2 hours. The feed compositions, pressures, catalyst compositions, product yields, and conversions of the 1-hexene feed are shown in Table 5.

TABLE 5

| | Example 32 | Example 33 | Example 34 | Example 35 | Example 36 | Example 37 | Example 38 |
|---|---|---|---|---|---|---|---|
| Feed composition[1] | | | | | | | |
| Hydrocarbon | 18 | 17 | 15 | 17 | 17 | 16 | 16 |
| Water | 91 | 91 | 90 | 91 | 91 | 91 | 91 |
| Reaction pressure[2] | 2600 | 3400 | 3450 | 3550 | 3550 | 3550 | 3300 |
| Catalyst composition[1] | | | | | | | |
| $RuCl_3 1\text{-}3H_2O$ | 0.05 | 0.05 | 0.05 | 0.05 | 0.05 | 0.05 | 0.05 |
| $Na_2CO_3$ | — | 0.3 | 0.3 | 0.6 | 0.3 | 0.3 | 0.3 |
| $TaCl_5$ | — | 0.2 | — | — | 0.2 | 0.2 | — |
| $TiO_2$ | — | — | — | — | — | — | 0.2 |
| Product Yields[3] | | | | | | | |
| Methane | 1 | 7 | 4 | 2 | 5 | 4 | 6 |
| n-pentane | 1 | 12 | 7 | 5 | 7 | 6 | 9 |
| n-hexane | 26 | 71 | 66 | 68 | 87 | 82 | 84 |
| Percent conversion of 1-hexene feed[3] | 97 | 98 | 97 | 97 | 98 | 99 | 99 |

Footnotes
[1]grams.
[2]pounds per square inch gauge.
[3]mole percent of 1-hexene feed.

The high conversion of 1-hexene in Example 32 reflects skeletal isomerization to methylpentenes and olefin-position isomerization to 2- and 3-hexene, but there was only a 26% yield of hexane with the unpromoted catalyst system. Addition of a transition metal oxide, a transition metal salt — for example tantalum pentachloride — which formed a transition metal oxide under the conditions employed, or a basic metal carbonate caused a substantial increase in the yield of hexane. When the catalyst system was basic, skeletal isomerization was completely suppressed, but olefin-position isomerization still occurred. None of the catalyst systems in Examples 32–38 were effective in cracking or hydrogenating the diluents, benzene and ethylbenzene. When ethylbenzene was used as the diluent, only trace amounts of dealkylated products, benzene and toluene, were produced.

Examples 39–45 demonstrate the relatively high efficiency of certain members of the catalyst system of the method of this invention in catalyzing the cracking of alkyl aromatics. In each Example, the hydrocarbon feed was a solution of 43 mole percent of 1-hexene and 57 mole percent of ethylbenzene. In each Example, the hydrocarbon and water were contacted for 2 hours in a 300-milliliter Hastelloy alloy B Magne-Dash autoclave at a reaction temperature of 662°F. and under an argon pressure of 650 pounds per square inch gauge. The feed compositions, reaction pressures, catalyst compositions and product yields are shown in Table 6.

Although all the catalyst systems employed in Examples 39–45 were effective in catalyzing water-forming activity involving 1-hexene, only iridium and rhodium were effective in cleaving ethylbenzene to benzene and toluene. Comparison of the product yields in Examples 42–44 indicates that cleavage of alkyl aromatics is effected using a catalyst system involving the combination of either iridium or rhodium with another one of the catalysts of this invention, but not iridium or rhodium alone.

TABLE 6

| | Example 39 | Example 40 | Example 41 | Example 42 | Example 43 | Example 44 | Example 45 |
|---|---|---|---|---|---|---|---|
| Feed composition[1] | | | | | | | |
| Hydrocarbon | 17 | 17 | 18 | 17 | 16 | 16 | 16 |
| Water | 89 | 91 | 90 | 90 | 91 | 90 | 90 |
| Reaction pressure[2] | 3200 | 3050 | 2900 | 2900 | 2650 | 2550 | 2550 |
| Catalyst composition[1] | | | | | | | |
| $RuCl_3.1\text{-}3H_20$ | — | 0.05 | 0.05 | 0.05 | 0.05 | 0.05 | 0.05 |
| $Na_2CO_3$ | 0.3 | 0.3 | 0.3 | 0.3 | 0.3 | 0.3 | 0.3 |
| $H_2PtCl_3$ | — | 0.1 | — | — | — | — | — |
| $CoCl_3$ | — | — | — | — | — | — | 0.1 |
| $IrCl_3.3H_2O$ | 0.05 | — | — | 0.1 | 0.2 | — | — |
| $RhCl_3.3H_2O$ | — | — | — | — | — | 0.10 | — |
| $PdCl_2$ | — | — | 0.1 | — | — | — | — |
| Yield | | | | | | | |
| Hexane[3] | 20 | 68 | 47 | 85 | 85 | 88 | 58 |
| Benzene[4] | 1 | 2 | 1 | 4 | 3 | 3 | 1 |
| Toluene[4] | 1 | 1 | 2 | 14 | 8 | 4 | 1 |

Footnotes
[1]grams.
[2]pounds per square inch gauge.
[3]produced from 1-hexene and reported as mole percent of 1-hexene feed.
[4]produced from ethylbenzene and reported as mole percent of alkylbenzene feed.

Examples 46–48 demonstrate that alkylbenzenes are cleaved using the method of this invention with the same catalyst system used in Example 42, even in the absence of an olefin in the hydrocarbon feed. Each of these Examples involve 2-hour runs in a 300-milliliter Hastelloy alloy B Magne-Dash reactor, at a reaction temperature of 662°F. and under an argon pressure of 650 pounds per square inch gauge. The hydrocarbon feed compositions, the amounts of water added, the reaction pressures, and the yields of products from the cracking of the alkyl aromatics are shown in Table 7.

Example 49 demonstrates that saturated hydrocarbons can be cracked in the method of this invention using the same catalyst system used in Example 42. In this Example, 15.9 grams of n-heptane and 92.4 grams of water were mixed in a 300-milliliter Hastelloy alloy B Magne-Dash autoclave and heated at a reaction temperature of 662°F. under a reaction pressure of 3100 pounds per square inch gauge and an argon pressure of 650 pounds per square inch gauge for a reaction time of 2 hours. Methane in the amount of 0.67 grams — corresponding to 4.2 weight percent of the n-heptane feed — was produced in the reaction. The fact that only methane were found indicates that when a molecule of saturated hydrocarbon cracks, it cracks to completion.

Examples 50–79 involve processing of tar sands oil feeds in a 300–milliliter Hastelloy alloy C Magne-Drive reactor. The properties of the tar sands feeds employed in these Examples are shown in Table 2. Topped tar sands oil is the straight tar sands oil whose properties are presented in Table 2 but from whch approximately 25 weight percent of light material has been removed. Straight tar sands oil was used as feed in Examples 50–65, while topped tar sands oil was used as feed in Examples 66–79. The experimental conditions used and the results of analyses of the products obtained in these Examples are shown in Tables 8 and 9, respectively. The reaction temperature was 752°F. in each Example. Ruthenium, rhodium, and osmium were added in the form of soluble $RuCl_3 \cdot 1\text{-}3H_2O$, $RhCl_3 \cdot 3H_2O$, and $OsCl_3 \cdot 3H_2O$, respectively.

TABLE 7

| | Example 46 | Example 47 | Example 48 |
|---|---|---|---|
| Feed composition[1] | | | |
| ethylbenzene | 0.15 | — | — |
| propylbenzene | — | 0.050 | — |
| toluene | — | — | 0.16 |
| n-heptane | — | 0.12 | — |
| water[2] | 91 | 91 | 92 |
| Reaction pressure[3] | 2450 | 3000 | 2900 |
| Product composition[1] | | | |
| methane | 0.05 | 0.05 | 0.008 |
| benzene | 0.001(1%)[4] | 0.001(2%)[4] | 0.005(3%)[4] |
| toluene | 0.018(12%)[4] | 0.007(14%)[4] | 0.15 |
| ethylbenzene[5] | 0.13 | 0.004(8%)[4] | 0.001(0.6%)[4] |
| propylbenzene | — | 0.039 | — |

Footnotes
[1]moles except where otherwise indicated.
[2]grams.
[3]pounds per square inch gauge.
[4]mole percent of the alkyl aromatic feed in parenthesis.
[5]including xylenes.

traces of products having a higher carbon number than

TABLE 8

| Example | Reaction Time[1] | Reaction Pressure[2] | Argon Pressure[2] | Amount of Water Added[3] | Oil-to-Water Weight Ratio | Catalyst | Amount of Catalyst Added[4] |
|---|---|---|---|---|---|---|---|
| 50 | 6 | 4550 | 450 | 91 | 1:3 | Rh+Os | .15 + .14 |
| 51 | 6 | 4650 | 450 | 90 | 1:3 | Ru | .15 |
| 52 | 2 | 4600 | 450 | 90 | 1:3 | Ru | .15 |
| 53 | 6 | 4400 | 450 | 90 | 1:3 | — | — |
| 54 | 3 | 4350 | 400 | 90 | 1:3 | — | — |
| 55 | 1 | 4350 | 400 | 90 | 1:3 | — | — |
| 56 | 3 | 4350 | 400 | 90 | 1:3 | Rh+Os | .15 + .14 |
| 57 | 1 | 4500 | 400 | 91 | 1:3 | Rh+Os | .15 + .14 |
| 58 | 1 | 4425 | 400 | 90 | 1:3 | Ru+Os | .15 + .14 |
| 59 | 2 | 4100 | 400 | 90 | 1:3 | $Fe_2O_3$+$KMnO_4$ | .10 + .10 |
| 60 | 1 | 4250 | 400 | 80 | 1:2 | Ru+Os | .15 + .20 |
| 61 | 1 | 4250 | 400 | 80 | 1:2 | Rh+Os | .15 + .20 |
| 62 | 1 | 4350 | 400 | 90 | 1:3 | $FeCl_3$+$MnO_2$ | .10 + .05 |
| 63 | 2 | 4200 | 400 | 80 | 1:3 | NaOH | .04 |
| 64 | 2 | 4200 | 400 | 80 | 1:3 | Ru+NaOH | .15 + .04 |
| 65 | 1 | 4300 | 400 | 91 | 1:3 | $MnO_2$ | .30 |
| 66 | 1 | 4300 | 400 | 90 | 1:3 | — | — |
| 67 | 3 | 4300 | 400 | 90 | 1:3 | — | — |
| 68 | 3 | 4300 | 400 | 90 | 1:3 | Rh+Os | .15 + .14 |
| 69 | 1 | 4350 | 400 | 90 | 1:3 | Rh+Os | .15 + .14 |
| 70 | 1 | 4450 | 400 | 90 | 1:3 | Ru+Os | .15 + .14 |
| 71 | 2 | 4150 | 400 | 80 | 3:8 | Ru | .15 |
| 72 | 2 | 4250 | 400 | 90 | 1:3 | $FeCl_3$+$KMnO_4$ | .10 + .10 |
| 73 | 1 | 4100 | 400 | 80 | 1:2 | Rh+Os | .15 + .20 |
| 74 | 1 | 4225 | 400 | 80 | 1:2 | Ru+Os | .15 + .20 |
| 75 | 1 | 4100 | 400 | 90 | 1:3 | $FeCl_3$+$MnO_2$ | .10 + .05 |
| 76 | 1 | 4300 | 400 | 90 | 1:3 | Ru+$MnO_2$ | .15 + .05 |
| 77 | 1 | 4300 | 400 | 90 | 1:3 | Ru+$MnO_2$ | .15 + .30 |
| 78 | 2 | 4350 | 400 | 80 | 1:3 | NaOH | .04 |

TABLE 8-continued

| Example | Reaction Time[1] | Reaction Pressure[2] | Argon Pressure[2] | Amount of Water Added[3] | Oil-to-Water Weight Ratio | Catalyst | Amount of Catalyst Added[4] |
|---|---|---|---|---|---|---|---|
| 79 | 1 | 4250 | 400 | 90 | 1:3 | $MnO_2$ | .30 |

Footnotes
[1]hours.
[2]pounds per square inch gauge.
[3]grams.
[4]The amounts of catalysts added are presented in grams and in the same order in which the corresponding catalysts are listed.

TABLE 9

| | Product Composition[1] | | | | Percent Removal of[2] | | | | | |
|---|---|---|---|---|---|---|---|---|---|---|
| Example | Gas | Light Ends | Heavy Ends | Solids | Sulfur | Nickel | Vanadium | H—C[3] | API Gravity[4] | Weight Balance[5] |
| 50 | 8.6 | 77.7 | 5.2 | 7.8 | 48 | — | — | — | — | 100.7 |
| 51 | 3.3 | 70.2 | 6.0 | 13.8 | 48 | — | — | — | — | 101.2 |
| 52 | 2.3 | 76.7 | 12.7 | 8.5 | 48 | — | — | — | — | 99.6 |
| 53 | 3.7 | 84.2 | 5.7 | 6.4 | 56 | — | — | — | — | 97.2 |
| 54 | 11.2 | 75.2 | 8.6 | 5.0 | 63 | 95 | 74 | 1.451 | 20.5 | 100.2 |
| 55 | 1.3 | 70.6 | 27.1 | 1.0 | 36 | 69 | 77 | 1.362 | 20.5 | 99.4 |
| 56 | 12.1 | 72.0 | 8.3 | 7.7 | 35 | 97 | 84 | 1.441 | 22.7 | 100.8 |
| 57 | 0.3 | 75.2 | 16.8 | 5.4 | 52 | — | 86 | 1.513 | — | 99.7 |
| 58 | 2.7 | 71.6 | 21.1 | 5.3 | 33 | 28 | 64 | 1.408 | 20.8 | 99.7 |
| 59 | 4.1 | 68.3 | 23.9 | 5.1 | 25 | 94 | 86 | — | 14.0 | 99.1 |
| 60 | 1.7 | 66.4 | 28.9 | 3.3 | — | — | — | — | — | 99.8 |
| 61 | 4.3 | 60.5 | 32.3 | 3.0 | 71 | 78 | 74 | — | 20.7 | 101.2 |
| 62 | 5.0 | 66.0 | 27.8 | 1.0 | 33 | 19 | 70 | — | — | 100.4 |
| 63 | 2.7 | 72.1 | 23.0 | 2.2 | 74 | 85 | 82 | — | — | 99.7 |
| 64 | 8.0 | 68.9 | 14.7 | 8.5 | 77 | 89 | 84 | — | — | 100.6 |
| 65 | 7.7 | 68.6 | 22.4 | 1.3 | 80 | 80 | 96 | — | — | 99.8 |
| 66 | 1.0 | 62.9 | 39.4 | 0.1 | 39 | 42 | 75 | — | — | 99.9 |
| 67 | 5.9 | 67.2 | 20.0 | 6.9 | 49 | 77 | 96 | 1.418 | 12.5 | 99.7 |
| 68 | 16.0 | 63.0 | 12.0 | 9.0 | 42 | 88 | 83 | 1.442 | 18.9 | 100.9 |
| 69 | 3.6 | 54.9 | 31.7 | 3.2 | 37 | 82 | 88 | 1.481 | 12.5 | 100.2 |
| 70 | 1.0 | 67.8 | 25.0 | 7.4 | 59 | 79 | 92 | 1.435 | 12.1 | 99.6 |
| 71 | 3.1 | 62.0 | 26.8 | 7.4 | 81 | 8 | 88 | — | 12.2 | 99.3 |
| 72 | 8.1 | 61.7 | 30.0 | 5.9 | 28 | 98 | 76 | — | 10.0 | 100.3 |
| 73 | 5.0 | 48.5 | 43.1 | 3.4 | — | — | — | — | — | 100.0 |
| 74 | 4.7 | 55.0 | 35.2 | 5.1 | 33 | 77 | 77 | — | 14.4 | 100.1 |
| 75 | 5.5 | 52.0 | 41.8 | 0.7 | 81 | 17 | 91 | — | — | 100.2 |
| 76 | 6.7 | 56.4 | 31.5 | 5.4 | 82 | 94 | 95 | — | — | 100.0 |
| 77 | 5.7 | 59.2 | 32.4 | 2.7 | 82 | 93 | 91 | — | — | 99.9 |
| 78 | 5.0 | 59.9 | 32.2 | 2.9 | 37 | 91 | 92 | — | — | 100.0 |
| 79 | 5.7 | 59.8 | 33.2 | 1.3 | 80 | 86 | 93 | — | — | 100.3 |

Footnotes
[1]weight percent of hydrocarbon feed.
[2]These values were obtained from analyses of the combined light and heavy ends.
[3]atom ratio of hydrogen-to-carbon.
[4]°API.
[5]Total weight percent of hydrocarbon and water feeds and catalyst recovered as product and water.

Each component of the catalyst system in each Example was added either in the form of its aqueous solution or as the solid in a solid-water slurry, depending on whether or not the component was water-soluble.

Comparison of the results shown in Table 9 shows that the production of gas and solid residue and the extent of removal of sulfur and metals increased when the reaction time increased from 1 to 3 hours, when no catalyst was added from an external source. Addition of a catalyst from an external source produced small increases in the yield of solid residues and in the API gravities of the liquid product, but, unlike with feeds other than tar sands oils, had little effect on yields from hydrocracking and on C/H atom ratios. Further, alteration of the oil-to-water weight ratio from 1:3 to 1:2 generally resulted in a decrease in the extent of removal of sulfur and metals and an adverse shift in the product distribution. With feeds other than tar sands oil, the shifts were less adverse with increases in the oil-to-water weight ratio, until 1:1 was reached.

The results for the heavier topped tar sands oil are similar to those for the straight tar sands oil. One difference is that the conversion of heavy ends to light ends for the topped tar sands oil continued to increase as the reaction time increased from 1 to 3 hours, while such conversion was substantially complete in about one hour for the straight tar sands oil.

The yields and compositions of the gas products obtained in a number of the Examples whose results are shown in Table 9 are indicated in Table 10. In all cases, the main component of the gas products was argon which was used in pressurization of the reactor and which is not reported in Table 10. Changing the oil-to-water weight ratio from 1:3 to 1:2 and/or increasing the reaction time resulted in increased yields of gas. Addition of a catalyst also caused an increase in the yield of gas.

TABLE 10

| Example | Presence of Externally Added Catalyst | Reaction Time[1] | Oil-to-water weight Ratio | Composition[2] of the Gas Products | | | Weight Percent Gas Products |
|---|---|---|---|---|---|---|---|
| | | | | $H_2$ | $CO_2$ | $CH_4$ | |
| 55 | No | 1 | 1:3 | 2.8 | 3.1 | 3.4 | 1.3 |
| 54 | No | 3 | 1:3 | 3.3 | 5.2 | 6.9 | 11.2 |
| 56 | Yes | 3 | 1:3 | — | 5.2 | 8.1 | 12.1 |
| 61 | Yes | 1 | 1:2 | 5.1 | 4.5 | 5.8 | 4.3 |
| 66 | No | 1 | 1:3 | 1.0 | 3.8 | 8.4 | 1.0 |
| 67 | No | 3 | 1:3 | 3.0 | 5.6 | 7.5 | 5.9 |
| 69 | Yes | 1 | 1:3 | 3.7 | 3.0 | 4.2 | 3.6 |
| 68 | Yes | 3 | 1:3 | 4.5 | 7.1 | 8.4 | 16.0 |

Footnotes
[1]hours
[2]mole percent of gas products

The presence of carbon dioxide and hydrogen among the gas products obtained in Examples 54, 55, 66 and 67 suggests that hydrogen and carbon monoxide were generated even without the addition of catalysts from an external source, probably with metals inherently present in the tar sands oils serving as catalysts.

Comparison of the results shown in Table 9 indicates that addition of catalysts generally resulted in a greater degree of desulfurization than that caused when no catalyst was added from an external source. Further, addition of a transition metal oxide or a basic metal hydroxide or carbonate either alone or as a promoter in the presence of a water-reforming catalyst markedly improved the degree of desulfurization. However, as with hydrocarbon feeds other than tar sands oils, the extent of desulfurization decreased with increasing reaction time. In all cases, the sulfur which was removed from the oil appeared as elemental sulfur and not as sulfur dioxide or hydrogen sulfide.

Comparison of the results shown in Table 9 indicates that there was substantial removal of metals even after a reaction time of less than 1 hour and even in the absence of a catalyst added from an external source. However, addition of a catalyst and/or a transition metal oxide or a basic metal hydroxide or carbonate promoter further increased the extent of demetalation.

Examples 80–133 involve batch runs in a 300-milliliter Hastelloy alloy C Magne-Drive reactor having Khafji and C atmospheric residual oils. The properties of these residual oils are shown in Table 2 and are designated by the letter B. Examples 80–97 involve Khafji atmospheric residual oil, while Examples 98–133 involve C atmospheric residual oil. The reaction conditions employed in these Examples is indicated in Table 11. All runs were made at 752°F., except where otherwise indicated in Table 11. The experimental results are indicated in Table 12.

TABLE 11

| Example | Reaction Time[1] | Reaction Pressure[2] | Argon Pressure[2] | Oil-to-Water Weight Ratio | Amount of Water Added[3] | Catalyst | Amount of Added Catalyst[8] |
|---|---|---|---|---|---|---|---|
| 80 | 13[9] | 3600 | 400 | 1:3.2 | 96 | Os[4] | 0.2 |
| 81 | 8[9] | 3650 | 400 | 1:3.2 | 96 | Ru[5] | 0.12 |
| 82 | 2[9] | 4550 | 450 | 1:3 | 90 | Rh[6],Os | 0.12, 0.17 |
| 83 | 6[9] | 3600 | 450 | 1:3 | 90 | — | — |
| 84 | 6[9] | 3600 | 450 | 1:3 | 90 | — | — |
| 85 | 6[9] | 2500 | 450 | 4:1 | 30 | — | — |
| 86 | 6 | 4450 | 450 | 1:3 | 90 | Rh,Os | 0.15, 0.14 |
| 87 | 4 | 4500 | 450 | 1:3 | 90 | Rh,Os | 0.15, 0.14 |
| 88 | 1 | 4400 | 400 | 1:3 | 90 | Ru,Os | 0.15, 0.14 |
| 89 | 1 | 4300 | 400 | 1:3 | 90 | Ru,Os | 0.3, 0.4 |
| 90 | 1 | 4150 | 400 | 1:3 | 90 | $FeCl_3$,$MnO_2$ | 0.1, 0.05 |
| 91 | 1 | 4150 | 400 | 1:2 | 80 | $FeCl_3$,$MnO_2$ | 0.1, 0.05 |
| 92 | 1 | 4150 | 400 | 1:3 | 90 | Ru,$Cr_2O_3$ | 0.15, 0.09 |
| 93 | 1 | 4300 | 400 | 1:3 | 90 | Ru,Os, $Cr_2O_3$ | 0.15, 0.2, 0.09 |
| 94 | 1 | 4100 | 400 | 1:2 | 80 | Ru,Os | 0.15, 0.2 |
| 95 | 1 | 4000 | 400 | 1:1 | 60 | Ru,Os | 0.15, 0.2 |
| 96 | 1 | 4250 | 400 | 1:2 | 80 | Ru,Os | 0.15, 0.2 |
| 97 | 1 | 4150 | 400 | 1:1 | 60 | Ru,Os | 0.15,0.2 |
| 98 | 1 | 4300 | 400 | 1:3 | 90 | Ru,$MnO_2$ | 0.15, 0.6 |
| 99 | 2 | 4300 | 400 | 1:3.75 | 80 | Ru,NaOH | 0.15, 10 |
| 100 | 1 | 4250 | 400 | 1:3 | 90 | Ru,Os, $Cr_2O_3$ | 0.15, 0.2, 0.09 |
| 101 | 1 | 4225 | 400 | 1:3 | 90 | Rh,Os | 0.15, 0.2 |
| 102 | 1 | 4200 | 400 | 1:3 | 90 | Rh,Os | 0.15, 0.2 |
| 103 | 1 | 4250 | 400 | 1:3 | 90 | Rh,Os | 0.15, 0.2 |
| 104 | 1 | 4100 | 400 | 1:1 | 60 | Ru,Os | 0.15, 0.2 |
| 105 | 1 | 4600 | 400 | 1:2 | 80 | Ru,Os, $H_2WO_4$ | 0.15, 0.2, 0.3 |
| 106 | 1 | 4400 | 400 | 1:2 | 80 | Ru,Os, $TiO_2$ | 0.15, 0.2, 0.3 |
| 107 | 1 | 4450 | 400 | 1:3 | 90 | KOH | 0.5 |
| 108 | 1 | 4550 | 400 | 1:3 | 90 | KOH | 1 |
| 109 | 2 | 4200 | 400 | 1:3 | 90 | Ru,$Na_2CO_3$ | 0.15, 0.3 |
| 110 | 2 | 4400 | 400 | 1:3 | 90 | Ru,$TaCl_5$, $Na_2CO_3$ | 0.15, 0.2, 0.3 |
| 111 | 2 | 4400 | 400 | 1:3 | 90[10] | Ru,$Na_2CO_3$ | 0.15, 0.3 |
| 112 | 18[11] | 3900 | 500 | 1:3 | 90 | Ru | 0.12 |
| 113 | 16[12] | 3775 | 450 | 1:3.2 | 96 | Os | 0.2 |
| 114 | 16[12] | 3650 | 500 | 1:3.2 | 96 | Ru | 0.2 |
| 115 | 6[12] | 3700 | | 1:3.2 | 96 | Rh,Os | 0.12, 0.22 |

TABLE 11-continued

| Example | Reaction Time[1] | Reaction Pressure[2] | Argon Pressure[2] | Oil-to-Water Weight Ratio | Amount of Water Added[3] | Catalyst | Amount of Added Catalyst[8] |
|---|---|---|---|---|---|---|---|
| 116 | 2 | 4550 | 450 | 1:3 | 90 | Rh,Os | 0.12, 0.17 |
| 117 | 6[12] | 2600 | 450 | 4:1 | 30 | — | — |
| 118 | 6[12] | 3600 | 450 | 1:3 | 90 | — | — |
| 119 | 6 | 4550 | 450 | 1:3 | 90 | Rh,Os | 0.15, 0.14 |
| 120 | 4 | 4450 | 450 | 1:3 | 91 | Rh,Os | 0.15, 0.14 |
| 121 | 2 | 4300 | 400 | 1:2 | 80 | Rh,Os | 0.15, 0.14 |
| 122 | 1 | 4275 | 400 | 1:2 | 80 | Rh,Os | 0.15, 0.14 |
| 123 | 0.5 | 4450 | 400 | 1:3 | 90 | Rh,Os | 0.15, 0.14 |
| 124 | 0.5 | 4375 | 400 | 1:3 | 90 | Rh,Os | 0.15, 0.14 |
| 125 | 1 | 4400 | 400 | 1:3 | — | Ru,Os | 0.3, 0.4 |
| 126 | 2 | 4400 | 400 | 1:3 | — | Ru,Os | 0.3, 0.4 |
| 127 | 1 | 4400 | 400 | 1:3 | — | Ru,Os | 0.3, 0.4 |
| 128 | 1 | 4200 | 400 | 1:3 | — | $FeCl_3$, $MnO_2$ | 0.1, 0.05 |
| 129 | 1 | 4200 | 400 | 1:2 | 80 | $FeCl_3$, $MnO_2$ | 0.1, 0.05 |
| 130 | 1 | 4300 | 400 | 1:3 | 90 | $Ru,Cr_2O_3$ | 0.15, 0.09 |
| 131 | 1 | 4150 | 400 | 1:3 | 90 | $Ru,MnO_2$ | 0.15, 0.05 |
| 132 | 1 | 4200 | 400 | 1:3 | 90 | $Ru,MnO_2$ | 0.15, 0.3 |
| 133 | 2 | 4250 | 300 | 1:3 | 90 | Ru,Ir[7] | 0.10, 0.10 |

[1]hours.
[2]pounds per square inch gauge.
[3]grams.
[4]added as $OsCl_3.3H_2O$.
[5]added as $RuCl_3.1\text{-}3H_2O$.
[6]added as $RhCl_3.3H_2O$.
[7]added as $IrCl_3.3H_2O$.
[8]The amounts of catalysts added are presented in grams and in the same order in which the corresponding catalysts are listed.
[9]The reaction temperature was 716°F.
[10]The water also contained 5 grams of 1-hexene as an additional source of hydrogen.
[11]The reaction temperature was 698°F.
[12]The reaction temperature was 710°F.

TABLE 12

| Example | Product Composition[1] | | | | Percent Removal of[2] | | | Mass Balance[3] |
|---|---|---|---|---|---|---|---|---|
| | Gas | Light Ends | Heavy Ends | Solids | Sulfur | Vanadium | Nickel | |
| 80 | 9.9 | 1.7 | 82.2 | 6.2 | 37 | — | — | 99.3 |
| 81 | 9.6 | 0 | 83.2 | 9.3 | 38 | — | — | 99.6 |
| 82 | 5.0 | 57.3 | 37.0 | 0.7 | 14 | — | — | 98.4 |
| 83 | 3.9 | 88.8[2] | | 0 | — | — | — | 92.7 |
| 84 | 4.0 | 49.2 | 45.0 | 1.8 | 35 | — | — | 102.3 |
| 85 | 2.5 | 37.4 | 60.8 | 0.3 | 22 | — | — | 97.1 |
| 86 | 7.1 | 69.9 | 13.2 | 9.8 | 22 | — | — | 103.6 |
| 87 | 6.8 | 66.2 | 15.3 | 11.7 | — | — | — | 98.3 |
| 88[4] | 2.0 | 60.7 | 38.3 | 4.8 | 50 | 84 | — | 101.2 |
| 89[5] | 0 | 58.2 | 32.0 | 10.8 | 69 | 98 | — | 101.9 |
| 90 | 0 | 56.6 | 43.5 | 2.0 | 82 | 98 | — | 100.4 |
| 91 | 0 | 57.2 | 43.4 | 1.3 | 72 | 98 | — | 100.5 |
| 92 | 7.3 | 42.7 | 47.1 | 2.7 | 78 | 98 | — | 100.0 |
| 93 | 6.7 | 51.6 | 37.5 | 4.2 | 61 | 80 | 26 | 100.1 |
| 94 | 2.4 | 47.0 | 48.0 | 2.6 | 72 | 98 | 52 | 99.2 |
| 95 | 1.5 | 52.6 | 44.0 | 2.6 | — | — | — | 98.9 |
| 96 | 4.5 | 52.2 | 41.1 | 2.3 | 26 | 98 | 81 | 99.7 |
| 97 | 2.2 | 45.5 | 50.0 | 2.5 | 13 | 84 | 74 | 99.3 |
| 98 | 4.0 | 54.9 | 37.6 | 3.5 | 72 | 72 | 75 | 99.5 |
| 99 | 3.3 | 66.8 | 29.8 | 6.1 | 27 | 92 | 88 | 100.4 |
| 100 | 6.7 | 57.3 | 35.3 | 4.3 | 24 | 76 | 81 | 100.5 |
| 101 | 7.0 | 58.9 | 39.1 | 2.2 | — | — | — | 101.1 |
| 102 | 2.9 | 50.5 | 43.2 | 3.4 | 77 | 76 | — | 99.3 |
| 103 | 3.3 | 56.9 | 38.1 | 1.7 | 23 | 76 | 62 | 100.2 |
| 104 | 2.8 | 53.1 | 42.3 | 1.8 | 23 | 92 | 38 | 99.8 |
| 105 | 2.0 | 68.3 | 26.4 | 3.4 | — | 92 | 56 | 99.6 |
| 106 | 3.3 | 61.3 | 31.8 | 3.9 | — | 92 | 88 | 100.4 |
| 107 | 1.3 | 54.3 | 36.9 | 7.5 | 79 | 92 | — | 100.6 |
| 108 | 2.0 | 51.7 | 39.7 | 6.7 | 82 | 90 | — | 101.1 |
| 109 | 2.7 | 48.0 | 43.3 | 9.5 | — | — | — | 102.7 |
| 110 | 3.6 | 62.0 | 31.2 | 5.2 | — | — | — | 100.4 |
| 111 | 4.3 | 60.6 | 30.2 | 4.9 | — | — | — | 98.0 |
| 112 | 6.3 | 36.6 | 48.0 | 6.1 | 47 | — | — | 96.6 |
| 113 | 22.0 | 17.0 | 60.0 | 10.2 | 42 | — | — | 91.5 |
| 114 | 12.0 | 8.0 | 71.1 | 10.0 | 30 | — | — | 91.8 |
| 115 | 4.5 | 56.8 | 38.6 | 5.3 | 30 | — | — | 101.3 |
| 116 | 6.3 | 66.8 | 26.7 | 4 | 23 | | — | 103.8 |
| 117 | 2.5 | 35.3 | 62.1 | 0.7 | 30 | — | — | 98.4 |
| 118 | 4.7 | 53.0 | 38.0 | 1.3 | 32 | — | — | 100.7 |
| 119 | 4.3 | 70.5 | 14.6 | 10 | 92 | — | — | 99.7 |
| 120 | 6.3 | 58.5 | 21.0 | 7.2 | 51 | — | — | 100.0 |
| 121 | 4.4 | 67.8 | 25.0 | 7.4 | 22 | 92 | — | 100.2 |
| 122 | 2.0 | 55.0 | 43.3 | 1.9 | 26 | 84 | — | 100.2 |
| 123 | 2.0 | 54.7 | 40.8 | 2.3 | 67 | 92 | — | 102.5 |
| 124 | 0.7 | 61.7 | 41.3 | 1.2 | 80 | 56 | — | 101.3 |
| 125 | 1.7 | 61.8 | 33.5 | 2.4 | 66 | 92 | — | 99.9 |
| 126 | 2.2 | 70.5 | 25.7 | 3.9 | 24 | 80 | — | 100.0 |

TABLE 12-continued

| Example | Product Composition[1] | | | | Percent Removal of[2] | | | Mass Balance[3] |
|---|---|---|---|---|---|---|---|---|
| | Gas | Light Ends | Heavy Ends | Solids | Sulfur | Vanadium | Nickel | |
| 127[6] | 0.3 | 64.0 | 33.3 | 5.7 | 68 | 98 | — | 100.3 |
| 128 | 0 | 53.4 | 49.5 | 0.6 | 77 | 98 | — | 99.9 |
| 129 | 0.7 | 54.9 | 42.8 | 1.5 | 65 | 98 | — | 99.9 |
| 130 | 9.1 | 45.3 | 44.6 | 2.5 | 79 | 98 | — | 101.1 |
| 131 | 6.0 | 47.5 | 44.6 | 1.9 | 80 | 98 | — | 101.1 |
| 132 | 0.3 | 56.0 | 41.0 | 2.7 | 79 | 98 | — | 99.9 |
| 133 | 7.0 | 56.0 | 31.0 | 6.0 | — | — | — | 100.2 |

[1]weight percent of the hydrocarbon feed.
[2]These values were obtained from analyses of the combined light and heavy ends.
[3]Total weight percent of hydrocarbon and water feed and catalyst recovered as product and water.
[4]The combined light ends and heavy ends fractions had a H/C atom ratio of 1.524.
[5]The combined light ends and heavy ends fractions had a H/C atom ratio of 1.644.
[6]The combined light ends and heavy ends fractions had a H/C atom ratio of 1.7.

The results in Table 12 indicate that cracking and desulfurization occurred in runs made in the absence of a catalyst added from an external source as well as in runs made with an added catalyst. However, addition of a catalyst from an external source significantly enhanced the yields of gases and of light ends, even after a greatly reduced reaction time. Further, addition of a promoter to the catalyst system caused an increase both in the absolute yield of gases and in the ratio of yields of gas-to-solid. Use of sufficient water to maintain a water density of at least 0.1 gram per milliliter — that is, use of hydrocarbon feed and water in proportions such that the weight ratio of water-to-hyrocarbon feed was relatively high — also caused a greater yield of gases and light ends, and a greater extent of desulfurization than when the weight ratio of water-to-hydrocarbon was relatively low. Addition of 1-hexene, a hydrogen donor, to the reaction mixture resulted in a lower yield of solid product and an increased yield of light ends.

In general, the extent of desulfurization increased when the reaction temperature was higher, when the reaction time was in a certain range, when the water-to-hydrocarbon feed weight ratio was higher, and when a promoter was added to the catalyst system. Further, use of the promoters even in the absence of a catalyst caused satisfactory desulfurization.

The sulfur which was removed from the residual oils appeared in the products as elemental sulfur when the density was at least 0.1 gram per milliliter — that is when a relatively low hydrocarbon-to-water feed weight ratio, such as 1:1, 1:2, and 1:3, was employed. When the water density was less than 0.1 gram per milliliter — that is, when a relatively high hydrocarbon-to-water weight ratio, such as 4:1,was employed — part of the sulfur removed from the hydrocarbon feed appeared in the products as hydrogen sulfide.

In general, the extent of demetalation increased when the water-to-hydrocarbon feed weight ratio was higher, when a promoter was added to the catalyst system and when the reaction time was in a certain range. Further, use of the promoters even in the absence of a catalyst caused satisfactory demetalation.

Examples 134–150 involve batch runs in a 300-milliliter Hastelloy alloy C Magne-Drive autoclave using C vacuum residual oil and Cyrus atmospheric residual oil. The properties of these residual oils are shown in Table 2 and are designated by the letter B. Examples 134–136 involve C vacuum residual oil, while Examples 137–150 involve Cyrus atmospheric residual oil. The reaction conditions employed in these Examples is indicated in Table 13. All runs were made at 752°F. The experimental results are indicated in Table 14.

The results in Table 14 indicate that satisfactory desulfurization and demetalation of C vacuum and Cyrus atmospheric residual oils were effected. Cracking of the C vacuum residual oil resulted in some formation of gases and light ends but not to the extent found with tar sands oils and with Khafji and C atmospheric residual oils.

TABLE 13

| Example | Reaction Time[1] | Reaction Pressure[2] | Argon Pressure[2] | Oil-to-Water Weight Ratio | Amount of Water Added[3] | Catalyst | Amount of Added Catalyst[7] |
|---|---|---|---|---|---|---|---|
| 134 | 1 | 4250 | 400 | 1:3 | 90 | Ru[4],Os[5],$Cr_2O_3$ | .15, .2, .09 |
| 135 | 2 | 4250 | 400 | 1:3 | 90 | Ru,Os,$Cr_2O_3$ | .15, .2, .09 |
| 136 | 1 | 4150 | 400 | 1:3 | 90 | KOH | 1 |
| 137 | 2 | 4550 | 450 | 1:3 | 92 | Ru | .12 |
| 138 | 2 | 4400 | 450 | 1:3 | 90 | — | |
| 139 | 2 | 4450 | 450 | 1:3 | 91 | Rh[6]+Os | .15, .14 |
| 140 | 2 | 4300 | 400 | 1:2.3 | 70[8] | Rh,Os | .15, .14 |
| 141 | 2 | 4100 | 400 | 1:2.3 | 70[8] | Rh,Os | .15, .14 |
| 142 | 2 | 3550 | 400 | 1:2.3 | 71[8] | Ru | .12 |
| 143 | 4 | 4400 | 400 | 1:2.3 | 70[9] | Ru | .12 |
| 144 | 2 | 4350 | 400 | 1:2.3 | 61[10] | Ru | .12 |
| 145 | 2 | 4350 | 350 | 1:2.3 | 61[11] | Ru | .12 |
| 146 | 2 | 4250 | 400 | 1:3 | 90 | Ru+Os | .12, .14 |
| 147 | 1 | 4350 | 400 | 1:3 | 90 | Ru+Os | .12, .14 |
| 148 | 1 | 4400 | 400 | 1:3 | 90 | Ru+Os | .3, .4 |
| 149 | 1 | 4200 | 400 | 1:2 | 90 | $FeCl_3$+$MnO_2$ | .1, .05 |

TABLE 13-continued

| Example | Reaction Time[1] | Reaction Pressure[2] | Argon Pressure[2] | Oil-to-Water Weight Ratio | Amount of Water Added[3] | Catalyst | Amount of Added Catalyst[7] |
|---|---|---|---|---|---|---|---|
| 150 | 1 | 4150 | 400 | 1:2 | 80 | $FeCl_3$+$MnO_2$ | .1, .05 |

[1]hours.
[2]pounds per square inch gauge.
[3]grams.
[4]added as $RuCl_3.1-3\ H_2O$
[5]added as $RhCl_3.3\ H_2O$
[6]added as $RhCl_3.3\ H_2O$
[7]The amounts of catalysts added are presented in grams and in the same order in which the corresponding catalysts are listed.
[8]The water also contained 10 grams of ethanol.
[9]The water also contained 10 grams of 1-hexene.
[10]The water also contained 20 grams of ethanol.
[11]The water also contained 30 grams of ethanol.

TABLE 14

| Example | Product Composition[1] Gas | Light Ends | Heavy Ends | Solids | Percent Removal of[2] Sulfur | Nickel | Vanadium | Mass Balance[3] |
|---|---|---|---|---|---|---|---|---|
| 134 | 6.7 | 32.3 | 58.0 | 3.0 | 84.7 | 92.6 | 20.5 | 100.6 |
| 135 | 13.1 | 34.0 | 47.6 | 5.3 | 56.7 | 66.7 | 76.5 | 100.5 |
| 136 | 1.3 | 29.7 | 60.8 | 8.2 | 90.0 | 96.0 | 24.0 | 100.1 |
| 137 | 7.3 | 55.6 | 27.3 | 10.0 | 36.2 | — | — | 100.7 |
| 138 | 4.6 | 49.9 | 33.0 | 12.0 | 26.9 | — | — | 100.6 |
| 139 | 7.0 | 6.4 | 83.9 | 9.3 | 21.3 | — | — | 99.8 |
| 140 | — | — | 33.3 | 11.8 | — | — | — | — |
| 141 | — | — | 44.5 | 28.3 | — | — | — | — |
| 142 | — | — | — | 6.3 | — | — | — | — |
| 143 | — | 66.6 | 24.3 | 13.4 | — | — | — | — |
| 144 | — | — | 79.0 | 6.7 | — | — | — | — |
| 145 | — | — | 42.0 | 5.7 | — | — | — | — |
| 146 | — | 55.0 | 35.2 | 10.0 | — | — | — | — |
| 147 | 1.7 | 53.5 | 41.6 | 7.7 | 53.0 | 96.0 | 24.0 | 100.5 |
| 148 | 0.3 | 64.2 | 33.7 | 5.7 | 68.0 | 87.4 | 0 | 101.6 |
| 149 | 3.6 | 47.6 | 44.1 | 2.7 | 76.0 | 99.0 | 0 | 99.2 |
| 150 | 0 | 23.0 | 75.5 | 1.8 | 80.2 | 95.0 | 17.0 | 99.8 |

[1]weight percent of the hydrocarbon feed.
[2]These values were obtained from analyses of the combined light and heavy ends.
[3]weight percent of hydrocarbon and water feed and catalyst recovered as product and water.

Cracking of the Cyrus atmospheric residual oil occurred more readily than cracking of C vacuum residual oil, but the Cyrus atmospheric residual oil appeared to be more refractory than the Khafji or C atmospheric residual oils. Cracking of the Cyrus atmospheric residual oil in the absence of a catalyst added from an external source resulted in a large yield of solid products. Cracking of this hydrocarbon feed in the presence of a ruthenium catalyst or rhodium -osmium combination catalyst added from an external source resulted in an increase in the yield of light ends but did not lower the yield of solid product. However, cracking of this hydrocarbon feed in the presence of an iron-manganese or ruthenium-osmium combination catalyst or with a hydrogen-donor, like ethanol or 1-hexene, added to the water solvent resulted in a lower yield of solid product and an increased yield of light ends.

Example 151 illustrates the denitrification of hydrocarbons by the method of this invention and involves a 2-hour batch run in a 300-milliliter Hastelloy alloy B Magne-Dash autoclave. In this Example 15.7 grams of 1-hexene were processed with 91.4 grams of water containing 1 milliliter (0.97 grams) of pyrrole, in the presence of 0.1 gram of soluble $RuCl_3.1-3H_2O$ catalyst, at a reaction temperature of 662°F., and under a reaction pressure of 3,380 pounds per square inch gauge and an argon pressure of 650 pounds per square inch gauge. The products included gases in the amount of 10.1 liters at normal temperature and pressure and 14.3 grams of liquid hydrocarbon product. The gas products were made up primarily of argon and contained 6.56 weight percent of carbon dioxide and 1.13 weight percent of methane. The amount of hexene in the product constituted 46.6 weight percent of the 1-hexene feed. The liquid hydrocarbon product contained 888 parts per million of nitrogen, for a 93 percent removal of nitrogen from the hydrocarbon feed.

Examples 152–154 illustrate that the catalyst of the method of this invention is nitrogen-resistant and involve 4-hour batch runs in a 300 milliliter Hastelloy alloy B Magne-Dash autoclave. In each of these examples, 12.8 grams of 1-hexene were processed with 90 grams of water at a reaction temperature of 662°F., under an argon pressure of 650 pounds per square inch gauge and in the presence of 2.0 grams of silicon dioxide containing 5 weight percent of ruthenium catalyst. The supported catalyst had been calcined in oxygen for 4 hours at 550°C. Examples 152, 153, and 154 were performed under a reaction pressure of 3,500, 3,500, and 3,400 pounds per square inch gauge, respectively. The reaction mixture in Examples 153 and 154 included additionally 1 milliliter (0.97 grams) of pyrrole. Example 154 was performed under identical conditions as those used in Example 153. Additionally, the same catalyst used in Example 153 was re-used in Example 154. The yields of hexane in Examples 152, 153, and 154 were 16.6, 14.0, and 13.9 weight percent of the 1-hexene feed, respectively. Within the ordinary experimental error of this work, these yields are the same.

EXAMPLES 155–164

Figure 3:
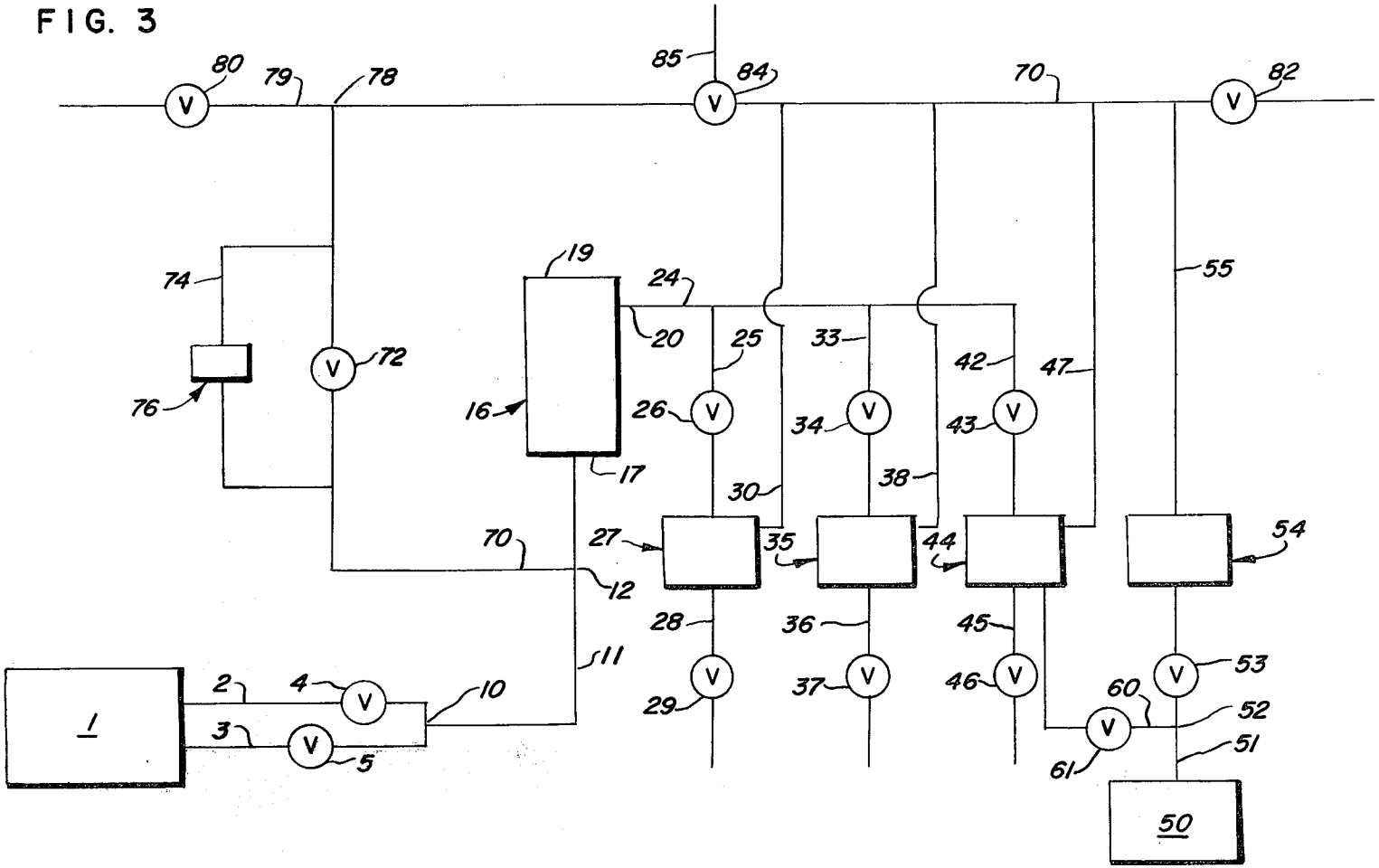
FIG. 3 is a schematic diagram of the flow system used in the method of this invention for semi-continuously processing a hydrocarbon fraction.

Examples 155–164 involve semi-continuous flow processing at 752°F. of straight tar sands oil under a variety of conditions. The flow system used in these Examples is shown in FIG. 3. To start a run, either one-eighth inch diameter inert, spherical alundum balls or irregularly shaped titanium oxide chips having 2 weight percent of ruthenium catalyst deposited thereon were packed through top 19 into a 21.5-inch long, 1-inch outside diameter and 0.25-inch inside diameter vertical Hastelloy alloy C pipe reactor 16. Top 19 was then closed and a furnace (not shown) was placed around the length of pipe reactor 16. Pipe reactor 16 had a total effective heated volume of about 12 milliliters, and the packing material had a total effective heated volume of about 6 milliliters, leaving approximately a 6-milliliter effective heated free space in pipe reactor 16.

All valves, except 53 and 61, were opened, and the flow system was flushed with argon or nitrogen. Then, with valves 4, 5, 29, 37, 46, 53, 61, and 84 closed and with Annin valve 82 set to release gas from the flow system where the desired pressure in the system was exceeded, the flow system was brought up to a pressure in the range of from about 1,000 to about 2,000 pounds per square inch gauge by argon or nitrogen entering the system through valve 80 and line 79. Then valve 80 was closed. Next, the pressure of the flow system was brought up to the desired reaction pressure by opening valve 53 and pumping water throgh Haskel pump 50 and line 51 into water tank 54. The water served to further compress the gas in the flow system and thereby to further increase the pressure in the system. If a greater volume of water than the volume of water tank 51 was needed to raise the pressure of the flow system to the desired level, then valve 61 was opened and additional water was pumped through line 60 and into dump tank 44. When the pressure of the flow system reached the desired pressure, valves 53 and 61 were closed.

A Ruska pump 1 was used to pump the hydrocarbon fraction and water into pipe reaction 16. The Ruska pump 1 contained two 250-milliliter barrels (not shown), with the hydrocarbon fraction being loaded into one barrel and water into the other, at ambient temperature and atmospheric pressure. Pistons (not shown) inside these barrels were manually turned on until the pressure in each barrel equaled the pressure of the flow system. When the pressures in the barrels and in the flow system were equal, check valves 4 and 5 opened to admit hydrocarbon fraction and water from the barrels to flow through lines 2 and 3. At the same time, valve 72 was closed to prevent flow in line 70 between points 12 and 78. Then the hydrocarbon fraction and water streams joined at point 10 at ambient temperature and at the desired pressure, flow through line 11, and entered the bottom 17 of pipe reactor 16. The reaction mixture flowed through pipe reactor 16 and exited from pipe reactor 16 through side arm 24 at point 20 in the wall of pipe reactor 16. Point 20 was 19 inches from bottom 17.

With solution flowing through pipe reactor 16, the furnace began heating pipe reactor 16. During heat-up of pipe reactor 16 and until steady state conditions were achieved, valves 26 and 34 were closed, and valve 43 was opened to permit the mixture in side arm 24 to flow through line 42 and to enter and be stored in dump tank 44. After steady state conditions were achieved, valve 43 was closed and valve 34 was opened for the desired period of time to permit the mixture in side arm 24 to flow through line 33 and to enter and be stored in product receiver 35. After collecting a batch of product in product receiver 35 for the desired period of time, valve 34 was closed and valve 26 was opened to permit the mixture in side arm 24 to flow through line 25 and to enter and be stored in product receiver 27 for another period of time. Then valve 26 was closed.

The material in side arm 24 was a mixture of gaseous and liquid phases. When such mixture entered dump tank 44, product receiver 35, or product receiver 27, the gaseous and liquid phases separated, and the gases exited from dump tank 44, product receiver 35, and product receiver 27 through lines 47, 38, and 30, respectively, and passed through line 70 and Annin valve 82 to a storage vessel (not shown).

When more than two batches of products were to be collected, valve 29 and/or valve 37 was opened to remove product from product receiver 27 and/or 35, respectively, to permit the same product receiver and/or receivers to be used to collect additional batches of product.

At the end of a run — during which the desired number of batches of product were collected — the temperature of pipe reactor 16 was lowered to ambient temperature and the flow system was depressurized by opening valve 84 in line 85 venting to the atmosphere.

Diaphragm 76 measured the pressure differential across the length of pipe reactor 16. No solution flowed through line 74.

The API gravity of the liquid products collected were measured, and their nickel, vanadium, and iron contents were determined by x-ray fluorescence.

The properties of the straight tar sands oil feed employed in Examples 155–164 are shown in Table 2. The tar sands oil feed contained 300–500 parts per million of iron, and the amount of 300 parts per million was used to determine the percent iron removed in the product. The experimental conditions and characteristics of the products formed in these Examples are presented in Table 15. The liquid hourly space velocity (LHSV) was calculated by dividing the total volumetric flos in milliters per hour, rate of water and oil feed passing through pipe reactor 16 by the volumetric free space in pipe reactor 16 — that is, 6 milliliters.

The above examples are presented only by way of illustration, and the invention should not be construed as limited thereto. The various components of the catalyst system of the method of this invention do not possess exactly identical effectiveness. The most advantageous selection of these components and their concentrations and of the other reaction conditions will depend on the particular hydrocarbon feed being processed.

TABLE 15

| | Example 155 | Example 156 | Example 157 | Example 158 | Example 159 | Example 160 | Example 161 | Example 162 | Example 163 | Example 164 |
|---|---|---|---|---|---|---|---|---|---|---|
| Reaction pressure[1] | 4100 | 4040 | 4060 | 4080 | 4100 | 4100 | 4100 | 4100 | 4020 | 4040 |

TABLE 15-continued

| | Example 155 | Example 156 | Example 157 | Example 158 | Example 159 | Example 160 | Example 161 | Example 162 | Example 163 | Example 164 |
|---|---|---|---|---|---|---|---|---|---|---|
| LHSV[2] | 1.0 | 1.0 | 1.0 | 1.0 | 2.0 | 2.0 | 2.0 | 2.0 | 2.0 | 2.0 |
| Oil-to-water volumetric flow rate ratio | 1:3 | 1:3 | 1:3 | 1:3 | 1:2 | 1:2 | 1:3 | 1:3 | 1:3 | 1:3 |
| Packing material | alundum | Ru,Ti | Ru,Ti | Ru,Ti | alundum | alundum | alundum | alundum | Ru,Ti | Ru,Ti |
| Product collected during period number[3] | 3 | 2 | 4 | 5 | 1 | 2 | 1+2 | 3 | 2 | 3 |
| Product characteristics | | | | | | | | | | |
| API gravity[4] | 21.0 | 21.0 | 23.0 | 20.0 | 17.8 | 17.3 | 21.0 | 22.9 | 20.0 | 20.0 |
| Percent nickel removed | 95 | 77 | 84 | 69 | 97 | 69 | 64 | 69 | 69 | 93 |
| Percent vanadium removed | 97 | 81 | 96 | 99 | 59 | 54 | 73 | 59 | 60 | 77 |
| Percent iron removed | 98 | 99 | 98 | 92 | — | — | 99 | 99 | 98 | 98 |

[1]pounds per square inch gauge.
[2]hours$^{-1}$.
[3]The number indicates the 7–8 hour period after start-up and during which feed flowed through pipe reactor 16.
[4]API.

We claim:

1. A process for cracking, hydrogenating, desulfurizing, demetalating, and denitrifying a hydrocarbon fraction containing paraffins, olefins, olefin-equivalents, or acetylenes, as such or as substituents on ring compounds, and sulfurous, metallic and nitrogenous components: comprising cracking hydrogenating, desulfurizing, demetalating, and denitrifying said hydrocarbon fraction by contacting said hydrocarbon fraction with a water-containing fluid at a temperature in the range of from about 600° to about 900°F., under super-atmospheric pressure, in the absence of externally supplied hydrogen, and in the presence of an externally supplied catalyst system containing a sulfur- and nitrogen-resistant catalyst selected from the group consisting of at least one soluble or insoluble transition metal compound and transition metal deposited on a support, said transition metal in said catalyst being selected from the group consisting of ruthenium, rhodium, iridium, osmium, and combinations thereof, wherein sufficient water is present in the water-containing fluid and said pressure is sufficiently high so that the water in the water-containing fluid has a density of at least 0.10 gram per milliliter and serves as an effective solvent for the hydrocarbon fraction, and wherein hydrogen is generated in situ; and lowering said temperature or pressure or both to thereby make the water in the water-containing fluid a less effective solvent for the hydrocarbon fraction and to thereby form separate phases, wherein essentially all the sulfur separated from the hydrocarbon fraction is in the form of elemental sulfur.

2. The process of claim 1 wherein the density of water in the water-containing fluid is at least 0.15 gram per milliliter.

3. The process of claim 2 wherein the density of water in the water-containing fluid is at least 0.2 gram per milliliter.

4. The process of claim 1 wherein the temperature is at least 705°F.

5. The process of claim 1 wherein the hydrocarbon fraction and water-containing fluid are contacted for a period of time in the range of from about 1 minute to about 6 hours.

6. The process of claim 5 wherein the hydrocarbon fraction and water-containing fluid are contacted for a period of time in the range of from about 5 minutes to about 3 hours.

7. The process of claim 6 wherein the hydrocarbon fraction and water-containing fluid are contacted for a period of time in the range of from about 10 minutes to about 1 hour.

8. The process of claim 1 wherein the weight ratio of the hydrocarbon fraction-to-water in the water-containing fluid is in the range from about 1:1 to about 1:10.

9. The process of claim 8 wherein the weight ratio of the hydrocarbon fraction-to-water in the water-containing fluid is in the range of from about 1:2 to about 1:3.

10. The process of claim 1 wherein the water-containing fluid is substantially water.

11. The process of claim 1 wherein the water-containing fluid is water.

12. The process of claim 1 wherein the catalyst is present in a catalytically effective amount which is equivalent to a concentration level in the water in the water-containing fluid in the range of from about 0.02 to about 1.0 weight percent.

13. The process of claim 12 wherein the catalyst is present in a catalytically effective amount which is equivalent to a concentration level in the water in the water-containing fluid in the range of from about 0.05 to about 0.15 weight percent.

14. The process of claim 1 wherein the catalyst system includes additionally a promoter selected from the group consisting of at least one basic metal hydroxide, basic metal carbonate, transition metal oxide, oxide-forming transition metal salt, and combinations thereof, wherein said promoter promotes the activity of the catalyst.

15. The process of claim 14 wherein the transition metal in the oxide and salt is selected from the group consisting of a transition metal of Group IVB, VB, VIB, and VIIB of the Periodic Chart.

16. The process of claim 15 wherein the transition metal in the oxide and salt is selected from the group consisting of vanadium, chromium, manganese, iron, titanium, molybdenum, copper, zirconium, niobium, tantalum, rhenium, and tungsten.

17. The process of claim 16 wherein the transition metal in the oxide and salt is selected from the group consisting of chromium, manganese, titanium, tantalum, and tungsten.

18. The process of claim 14 wherein the metal in the basic metal carbonate and hydroxide is selected from the group consisting of alkali and alkaline earth metals.

19. The process of claim 18 wherein the metal in the basic metal carbonate and hydroxide is selected from the group consisting of sodium and potassium.

20. The process of claim 14 wherein the ratio of the number of atoms of metal in the promoter to the number of atoms of metal in the catalyst is in the range of from about 0.5 to about 50.

21. The process of claim 20 wherein the ratio of the number of atoms of metal in the promoter to the numer of atoms of metal in the catalyst is in the range of from about 3 to about 5.

22. The process of claim 1 wherein the hydrocarbon fraction is contacted with the water-containing fluid in the absence of pretreatment of the hydrocarbon fraction.

* * * * *

UNITED STATES PATENT OFFICE

CERTIFICATE OF CORRECTION

Patent No. 3,960,706 Dated June 1, 1976

Inventor(s) John D. McCollum et al.

It is certified that error appears in the above-identified patent and that said Letters Patent are hereby corrected as shown below:

Column 6, line 10, "1-hexane" should be -- 1-hexene --.

" 11, " 66, "5.4 to 6" should be -- 5.4 or 6 --.

" 22, " 25, "having" should be -- using --.

" 24, Example 124, "Rh,Os" should be -- Ru,Os --.

" 29, line 43, "pipe reaction" should be -- pipe reactor --.

" 30, " 51, "flos" should be -- flows --.

" 31, " 33, "cracking hydrogenating" should be -- cracking, hydrogenating --.

" 34, " 9, "the numer" should be -- the number --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*